US007344778B2

(12) United States Patent
Nakamura

(10) Patent No.: US 7,344,778 B2
(45) Date of Patent: Mar. 18, 2008

(54) POWDER-COATED SUPPORT AND PRODUCTION METHOD THEREOF

(75) Inventor: Yoshisada Nakamura, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 550 days.

(21) Appl. No.: 10/661,566

(22) Filed: Sep. 15, 2003

(65) Prior Publication Data

US 2004/0058166 A1 Mar. 25, 2004

(30) Foreign Application Priority Data

Sep. 19, 2002 (JP) ..... 2002-273815

(51) Int. Cl.
*B32B 5/66* (2006.01)

(52) U.S. Cl. ..... 428/402; 428/403; 428/404; 428/405; 428/406; 428/407; 428/536; 427/391

(58) Field of Classification Search ..... 428/402, 428/403, 405, 404, 406, 407, 536; 427/391
See application file for complete search history.

(56) References Cited

U.S. PATENT DOCUMENTS 4,113,576 A * 9/1978 Hutkin ..... 428/626
5,411,830 A * 5/1995 Matsunaga ..... 430/106.2
5,424,810 A * 6/1995 Tomiyama et al. ..... 430/106.2
5,447,767 A * 9/1995 Tanabe et al. ..... 428/64.4
6,369,157 B1 * 4/2002 Winckler et al. ..... 524/783

FOREIGN PATENT DOCUMENTS

JP 4-234755 8/1992

* cited by examiner

*Primary Examiner*—Leszek Kiliman
(74) *Attorney, Agent, or Firm*—Sughrue Mion, PLLC

(57) ABSTRACT

An object is to provide a method for efficiently producing a powder-coated support, which does not require a drying process and can use, without limitation, even a resin that hardly forms a latex or an aqueous solution, and to provide a powder-coated support obtained by the production method, which exhibits less swelling of its base paper and has excellent smoothness and glossiness. A method produces a powder-coated support by applying a powdery resin composition containing at least a thermoplastic resin to at least one side of a base paper, and hot-pressing the resulting article. The hot pressing is preferably performed by heating the article at a temperature equal to or higher than the melt-starting temperature of the thermoplastic resin and cooling the same to a temperature of 80° C. or lower using a powder coating machine of cooling-removing system.

15 Claims, 3 Drawing Sheets

POWDER-COATED SUPPORT AND PRODUCTION METHOD THEREOF

BACKGROUND OF THE INVENTION

1. Field of the Invention

The present invention relates to a method for efficiently producing a powder-coated support, which does not require a drying process and can use, without limitation, even a resin that hardly form a latex or an aqueous solution, and to a powder-coated support obtained by the production method, which exhibits less swelling and has excellent smoothness and glossiness.

2. Description of the Related Art

Conventional supports for use in image forming materials include, for example, base paper, synthetic paper, synthetic resin sheets, coated paper, and laminated paper. Among them, coated paper and laminated paper are particularly advantageously used for their high quality.

The coated paper and laminated paper are produced, for example, by a solvent coating process in which a thermoplastic resin is dissolved in an organic solvent and is applied to a base paper; an aqueous coating process in which a thermoplastic resin is formed into a latex or an aqueous solution (varnish) and is applied to a base paper; a dry laminate process in which a thermoplastic resin is dry-laminated onto a base paper; or a melt extrusion coating process.

However, the solvent coating process uses a deleterious organic solvent and thus adversely affects the environment.

In the aqueous coating process, the base paper swells upon coating due to water in the latex or the aqueous solution (varnish) and loses its smoothness. For example, Japanese Patent Application Laid-Open (JP-A) No. 04-234755 proposes a support for photographic printing paper. The support is prepared by forming a coated layer of composite particles containing polyolefin resin particles and a white pigment on a base sheet, heating, melting, and solidifying the coated layer to thereby form a resin coated layer on the base. However, according to the proposed technique, the particle dispersion is applied to the support (raw paper) and is dried, thus inviting swelling of the support. The resulting support has insufficient smoothness and glossiness. In addition, the aqueous coating process cannot be applied to resins that cannot yield latices or aqueous solutions.

SUMMARY OF THE INVENTION

Accordingly, an object of the present invention is to provide a method for efficiently producing a powder-coated support, which does not require a drying process and can use, without limitation, even a resin that hardly forms a latex or an aqueous solution, and to provide a powder-coated support obtained by the production method, which exhibits less swelling and has excellent smoothness and glossiness.

A method for producing a powder-coated support according to the present invention applies a powdery resin composition containing at least a thermoplastic resin to at least one side of a base paper, and hot-presses the applied powdery resin composition on the base paper. The method thereby does not require a drying process, can use, without limitation, even a resin that hardly forms a latex or an aqueous solution and can efficiently produce a powder-coated support having excellent smoothness and glossiness.

A powder-coated support of the present invention is produced by the above production method according to the present invention. The powder-coated support has excellent smoothness and glossiness and can be advantageously used in, for example, recording materials selected from electrophotographic materials, thermosensitive materials, sublimation transfer materials, silver halide photographic materials, ink-jet recording materials, and thermal transfer materials.

Further objects, features and advantages of the present invention will become apparent from the following description of the preferred embodiments with reference to the attached drawings.

DESCRIPTION OF THE PREFERRED EMBODIMENTS

Method for Producing Powder-Coated Support

Figure 1:
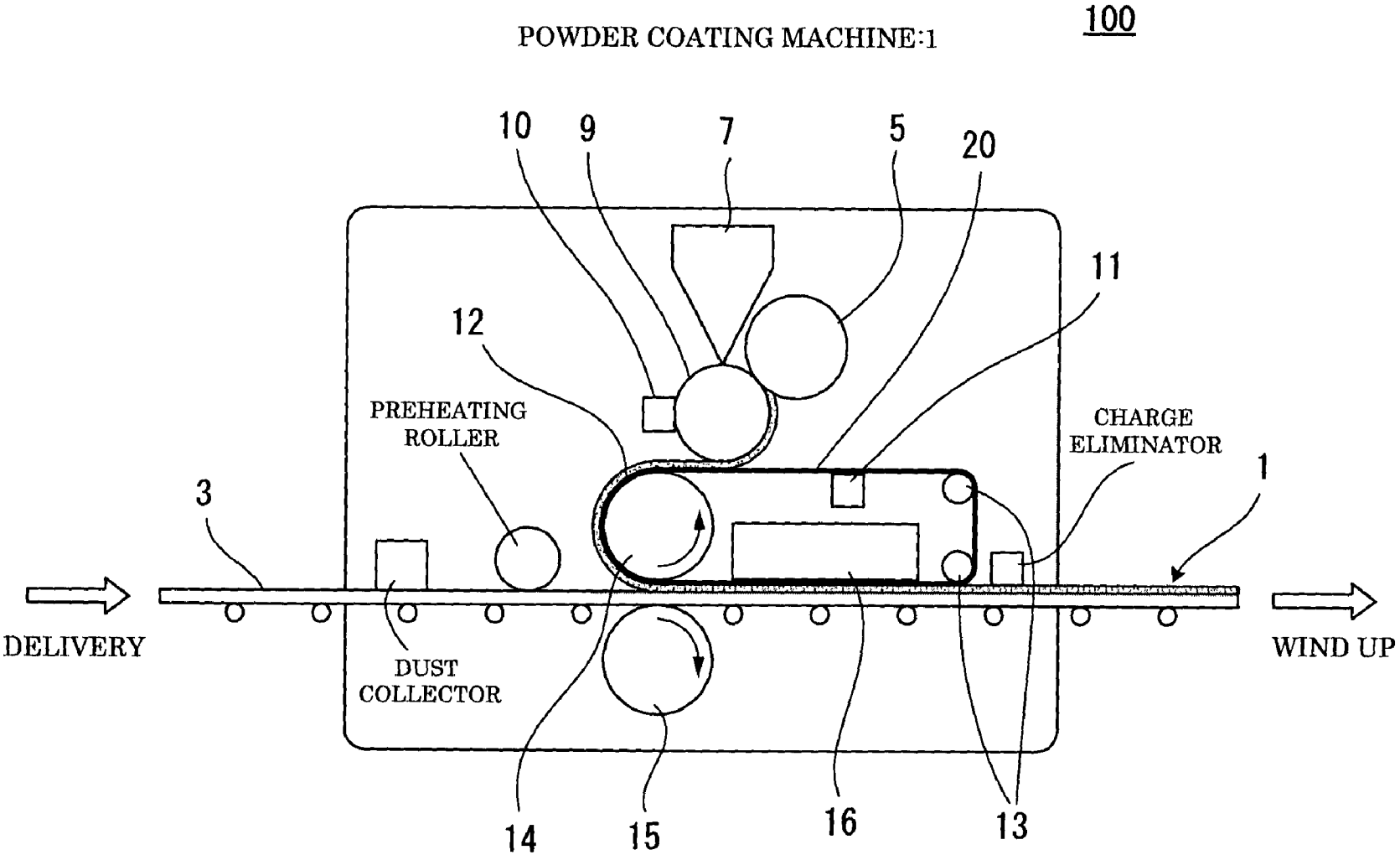
FIG. 1 is a schematic view of an example of a powder coating machine of cooling-removing system for use in the present invention.

The method for producing a powder-coated support of the present invention applies a powdery resin composition comprising at least a thermoplastic resin to at least one side of a base paper, and heats and pressurizes the applied powdery resin composition on the base paper. It is preferred that the methods electrostatically applies the powdery resin composition to at least one side of the base paper, and hot-presses and then cools the coated layer of the powdery resin composition on the base paper using a belt member and a roller of a powder coating machine that can cool and thereby remove an article and removes the coated layer on the base paper from the belt member.

Base Paper

As the base paper, a raw paper is preferably used. Preferred examples of the raw paper are woodfree paper and paper described in "Basis of Photographic Technology—silver halide photography—" edited by The Society of Photographic Science and Technology of Japan, Corona Publishing Co., Ltd., Japan, pp. 223-240 (1979).

Materials for the raw paper are not specifically limited, can be appropriately selected according to an intended purpose and include, for example, natural pulp such as softwood pulp and hardwood pulp; synthetic pulp such as those made from plastic materials such as polyethylenes and polypropylenes; and mixtures of natural pulp and synthetic pulp.

The pulp for use as the material for the raw paper is preferably latifoliate tree bleached kraft pulp (LBKP) for satisfactorily balanced surface smoothness, rigidity and dimensional stability (anti-curling properties) at sufficient level. Needle-leafs tree bleached kraft pulp (NBKP), latifoliate tree sulfite pulp, and other pulp can also be used as the pulp.

The pulp preferably mainly comprises latifoliate tree pulp inherently having shorter fibers.

The pulp can be beaten with a beater or refiner. A pulp slurry (hereinafter referred to as "pulp stock") obtained by beating the pulp may further comprise various additives. Such additives include, but are not limited to, fillers, agents for enhancing dry strength of paper, sizing agents, agents for enhancing wet strength of paper, bonding agents, pH adjusters, and other agents.

The fillers include, but are not limited to, calcium carbonate, clay, kaolin, China clay, talc, titanium dioxide, diatomaceous earth, barium sulfate, aluminum hydroxide, and magnesium hydroxide.

The agents for enhancing dry strength of paper include, but are not limited to, cationized starch, cationic polyacrylamides, anionic polyacrylamides, amphoteric polyacrylamides, and carboxy-modified poly(vinyl alcohol)s.

The sizing agents include, but are not limited to, fatty acid salts, rosin, maleic acid-added rosin, and other rosin derivatives, paraffin waxes, alkyl ketene dimers, alkenyl succinic anhydrides (ASAs); and compounds containing higher fatty acids such as epoxidized fatty acid amides.

The agents for enhancing wet strength of paper include, but are not limited to, polyamine-polyamide-epichlorohydrin, melamine resins, urea resins, and epoxidized polyamide resins.

The bonding agents (fixing agents) include, but are not limited to, aluminum sulfate, aluminum chloride, and other polyvalent metallic salts; cationized starch and other cationic polymers.

The pH adjusters include, but are not limited to, sodium hydroxide, and sodium carbonate.

The other agents include, but are not limited to, antifoaming agents, dyes, slime control agents, and fluorescent brightening agents (fluorescent whitening agents).

The pulp stock may further comprise a softening agent. Examples of the softening agent can be found in, for example, New Paper Processing Handbook (Shigyo Taimususha Ltd., Japan) p. 554-555 (1980).

A composition for use in the surface sizing may comprise, for example, a water-soluble polymer, a water-resistant substance, and/or a pigment. Such water-soluble polymers include, but are not limited to, cationized starch, poly(vinyl alcohol)s, carboxy-modified poly(vinyl alcohol)s, carboxymethylcellulose, hydroxyethylcellulose, cellulose sulfate, gelatin, casein, poly(sodium acrylate)s, sodium salt of styrene-maleic anhydride copolymers, and poly(sodium styrenesulfonate)s.

Examples of the water-resistant substance are latices and emulsions of, for example, styrene-butadiene copolymers, ethylene-vinyl acetate copolymers, polyethylenes, vinylidene chloride copolymers, and polyamide-polyamine-epichlorohydrin.

Examples of the pigment are calcium carbonate, clay, kaolin, talc, barium sulfate, and titanium dioxide.

To improve the rigidity (stiffness) and dimensional stability (anti-curling properties) of the powder-coated support, the raw paper preferably has the ratio (Ea/Eb) of a longitudinal Young's modulus Ea to a transverse Young's modulus Eb of from 1.5 to 2.0. If the ratio Ea/Eb is less than 1.5 or exceeds 2.0, the rigidity and anti-curling properties of the powder-coated support may apt to decrease, thus the resulting powder-coated support may not be carried or conveyed satisfactorily.

The Oken type smoothness of the raw paper on the image forming layer side is preferably 210 seconds or more, and more preferably 250 seconds or more. If the Oken type smoothness is less than 210 seconds, the resulting image may have deteriorated quality. Although the upper limit of the Oken type smoothness is not specifically limited, it is actually about 600 seconds, and preferably about 500 seconds.

The Oken type smoothness used herein means a smoothness specified in No. 5 method B by Japan Technical Association of the Pulp and Paper Industry (JAPAN TAPPI).

It has been found that in general, the "tone" of the paper differs based on differences in the way the paper is beaten, and the elasticity (modulus) of paper from paper-making after beating can be used as an important indication of the "tone" of the paper. The elastic modulus of the paper may be calculated from the following Equation 1 by using the relation of the dynamic modulus which shows the physical properties of a viscoelastic object and density, and measuring the velocity of sound propagation in the paper using an ultrasonic oscillator.

$$E=\rho c^2(1-n^2) \quad \text{<Equation 1>}$$

In Equation 1, E is a dynamic modulus of elasticity; ρ is a density; c is a sonic velocity in the paper; and n is a Poisson's ratio.

As n=0.2 in the case of ordinary paper, there is not much difference in the calculation if the calculation is performed by the following equation:

$$E=\rho c^2$$

Accordingly, if the density of the paper and acoustic velocity can be measured, the elastic modulus can easily be calculated. In the above equation, when measuring acoustic velocity, various instruments known in the art may be used, such as a Sonic Tester SST-110 (Nomura Shoji Co., Ltd.).

The thickness of the base paper is not specifically limited, can be appropriately set according to an intended purpose and is preferably from 30 μm to 500 μm, more preferably from 50 μm to 300 μm, and further preferably from 100 μm to 250 μm. The basis weight of the base paper is, for example, preferably from 50 g/m$^2$ to 250 g/m$^2$, and more preferably from 100 g/m$^2$ to 200 g/m$^2$.

In the above base paper, it is preferred to use pulp fibers having a fiber length distribution as disclosed for example by Japanese Patent Application Laid-Open (JP-A) No. 58-68037 (e.g., the sum of 24-mesh screen residue and 42-mesh screen residue is 20% by mass to 45% by mass, and 24-mesh screen residue is 5% by mass or less) in order to give the desired center line average roughness to the surface. Moreover, the center line average roughness can be adjusted by giving a surface treatment of heat and pressure in a machine calender, super calender, etc.

Powdery Resin Composition

The powdery resin composition comprises at least one thermoplastic resin and may further comprise other components according to necessity.

The thermoplastic resin for use herein is not specifically limited and can be selected according to an intended purpose, as long as it is substantially optically transparent. Such thermoplastic resins include, but are not limited to, polyester resins, polystyrene resins, acrylic resins, vinyl resins, polycarbonate resins, polyamide resins, polyimide resins, epoxy resins, polyurea resins, styrene-acrylic resins, polyethylene resins, ionomer resins, polyurethane resins, and copolymers derived from these resins. Among them, polyester resins, acrylic resins, styrene-acrylic resins, polyethylene resins, ionomer resins, and polyurethane resins are preferred for achieving satisfactory image-fixing properties at low temperatures, image-fixing strength, and storage stability concurrently.

The powdery resin composition may further comprise various additives according to necessity, in addition to the thermoplastic resin. Such additives include, but are not limited to, white pigments; fluorescent brightening agents;

ultramarine blue, and other pigments for color adjustment; UV absorbents; mica, synthetic mica, and other gas-barrier materials; hollow particles, especially glass hollow particles, and other heat insulating materials.

The white pigments are not specifically limited, can be selected according to an intended purpose and include, for example, titanium dioxide, calcium carbonate, barium sulfate, and zinc white. Among them, titanium dioxide is preferred for its high masking property. The titanium dioxide can be prepared by any process such as a sulfuric acid process, a hydrochloric acid process, and a gas phase process. It can have any crystal form selected from anatase, rutile, and brookite crystal forms.

The content of the white pigment, if any, is preferably from 1% by mass to 40% by mass, and more preferably from 1% by mass to 25% by mass to the thermoplastic resin in the powdery resin composition. If the content of the white pigment is less than 1% by mass, the powdery resin composition may not have sufficient masking property. If it exceeds 40% by mass, the white pigment may not be satisfactorily combined with and dispersed in the thermoplastic resin.

The fluorescent brightening agents are not specifically limited and can be appropriately selected according to an intended purpose, as long as they have absorption in near-UV regions and emit fluorescence at 400 nm to 500 nm. Typical disclosure of such fluorescent brightening agents can be found in, for example, K. Venkataraman (Ed.) "The Chemistry of Synthetic Dyes" Vol. V, 8, Academic Press, NY (1971). Examples of the fluorescence brightening agents are stilbene compounds, coumarin compounds, biphenyl compounds, benzoxazoline compounds, naphthalimide compounds, pyrazoline compounds, and carbostyril compounds.

These fluorescent brightening agents are commercially available under the trade names of Whitex PSN, PHR, HCS, PCS and B from Sumitomo Chemical Co., Ltd., Japan; and UVITEX-OB from Ciba Specialty Chemicals, Switzerland.

The UV absorbents include, for example, benzotriazole compounds (U.S. Pat. No. 3,533,794), 4-thiazolidone compounds (U.S. Pat. No. 3,352,681), benzophenone compounds (JP-A No. 46-2784), and ultraviolet absorbing polymers (JP-A No. 62-260152).

The powdery resin composition must be controlled in its fluidity and electrostatic properties so as to obtain high and uniform glossiness. To this end, at least one of inorganic fine particles and organic fine particles is preferably externally added or attached to the surface of the powdery resin composition particles.

Materials for the inorganic fine particles are not specifically limited, can be selected according to an intended purpose and include, for example, silica, titanium dioxide, tin oxide, and molybdenum oxide. For further stable electrostatic properties, these inorganic fine particles may be subjected to hydrophobing treatment with, for example, a silane coupling agent or a titanium coupling agent.

Materials for the organic fine particles are not specifically limited, can be selected according to an intended purpose and include, for example, polyester resins, polystyrene resins, polyacrylic resins, vinyl resins, polycarbonate resins, polyamide resins, polyimide resins, epoxy resins, polyurea resins, and fluorocarbon resins.

The average particle diameter of the inorganic fine particles and the organic fine particles is not specifically limited, can be set according to an intended purpose and is preferably from 0.005 μm to 1 μm, and more preferably from 0.01 μm to 1 μm.

If the average particle diameter is less than 0.005 μm, the inorganic fine particles and/or the organic fine particles attached to the surface of the powdery resin composition may aggregate so as to fail to achieve desired advantages. If it exceeds 1 μm, the resulting image may not have sufficiently higher glossiness.

The powdery resin composition preferably further comprises a mold releasing agent to prevent offset to, for example, rollers in the hot pressing procedure. Such mold releasing agents are not specifically limited, can be selected according to an intended purpose and include, for example, waxes, fluorocarbon resins, silicone resins, polyethylene resins, and polypropylene resins.

The powdery resin composition can be used a two-component powder by mixing with an appropriate carrier. Such carriers for use herein are not specifically limited, can be selected according to an intended purpose and are preferably those comprising a core and a resin layer covering the core.

Methods for producing particles of the powdery resin composition are not specifically limited, can be selected according to an intended purpose and include, for example, a method in which a coating liquid for the powdery resin composition is applied by spray coating, and a method in which the powdery resin composition is treated with a conventional grinder such as a ball mill, a roll mill, an angmill, and a sand mill.

Hot Pressing

The powdery resin composition comprising at least a thermoplastic resin is applied to at least one side of the base paper and is hot-pressed. The hot pressing process is preferably performed by using a belt fixing device that can cool and thereby remove an article and has hot-pressing means (heating and pressurizing means), a belt member, and cooling means.

The hot pressing means for use in the belt fixing device that can cool and thereby remove an article is not specifically limited, can be appropriately selected according to an intended purpose and is, for example, a combination of a heating roller, a pressure roller, and an endless belt.

The surface temperature of a metallic roll in the hot pressing process is preferably 100° C. or higher, more preferably 120° C. or higher, and further preferably 130° C. or higher. If the surface temperature of the metallic roll is lower than 100° C., the resulting support may have decreased flatness (smoothness) and particularly insufficient glossiness.

The nip pressure is preferably from 1 $kgf/cm^2$ to 10 $kgf/cm^2$, and more preferably from 2 $kgf/cm^2$ to 7 $kgf/cm^2$. If the nip pressure is less than 1 $kgf/cm^2$, the resulting support may have decreased flatness (smoothness) and particularly insufficient glossiness. If it exceeds 10 $kgf/cm^2$, the support and the belt may adhere with each other, thus causing adhesion problems.

The cooling means includes, but is not specifically limited to, cooling units and heatsinks that can supply cooling air and can control cooling temperature and other conditions.

The belt member preferably has, on its surface, a layer comprising at least one of silicone rubbers, fluorocarbon rubbers, silicone resins, fluorocarbon resins, and mixtures thereof. The belt member more preferably has a layer comprising a fluorocarbonsiloxane rubber on its surface, and further preferably has a layer comprising a silicone rubber on its surface, which silicone rubber layer has a layer comprising a fluorocarbonsiloxane rubber on its surface.

The fluorocarbonsiloxane rubber preferably has at least one of perfluoroalkyl ether groups and perfluoroalkyl groups in its principal chain.

An preferred example of the fluorocarbonsiloxane rubber is a cured product of a fluorocarbonsiloxane rubber composition comprising: (A) a fluorocarbon polymer mainly comprising a fluorocarbonsiloxane represented by following Formula (1) and having an aliphatic unsaturated group; (B) an organopolysiloxane and/or a fluorocarbonsiloxane having two or more ≡SiH groups per molecule in a content of one to four times by mole the amount of the aliphatic unsaturated group in the fluorocarbonsiloxane rubber composition; (C) a filler; and (D) an effective amount of a catalyst.

The fluorocarbon polymer of component (A) comprises a fluorocarbon siloxane containing a repeating unit represented by the following general formula (1) as its main component, and contains aliphatic unsaturated groups.

In Component (B), one example of the organopolysiloxane comprising ≡SiH groups is an organohydrogenpolysiloxane having at least two hydrogen atoms bonded to silicon atoms in the molecule.

In the fluorocarbon siloxane rubber composition, when the fluorocarbon polymer of the above Component (A) comprises an aliphatic unsaturated group, the above organohydrogenpolysiloxane preferably be used as the above curing agent. Specifically, in this case, the cured product is formed by an addition reaction between aliphatic unsaturated groups in the fluorocarbon siloxane, and hydrogen atoms bonded to silicon atoms in the organohydrogenpolysiloxane.

Examples of the above organohydrogenpolysiloxanes are the various organohydrogenpolysiloxanes used in addition curing silicone rubber compositions.

Formula (1)

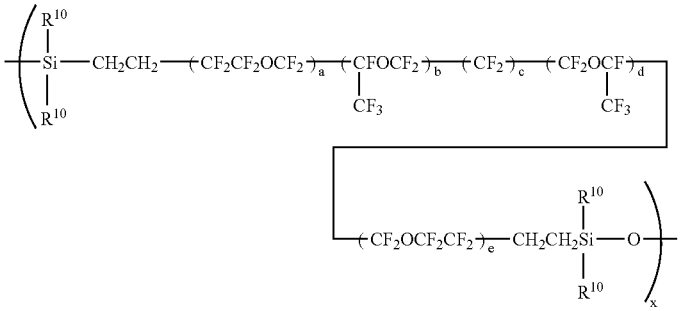

Herein, in the above formula (1), $R^{10}$ is a non-substituted or substituted monofunctional hydrocarbon group preferably containing 1 to 8 carbon atoms, preferably an alkyl group containing 1 to 8 carbon atoms or an alkenyl group containing 2 to 3 carbon atoms, and particularly preferably methyl. The letters "a" and "e" are independently 0 or 1; "b" and "d" are independently integers in the range of from 1 to 4, and "c" is an integer in the range of from 0 to 8. The letter "x" is an integer equal to 1 or more, which is preferably 10 to 30.

An example of the above component (A) is the substance shown by the following formula (2):

The organohydrogenpolysiloxane preferably has one or more ≡SiH groups, and more preferably one to five ≡SiH groups per one aliphatic unsaturated hydrocarbon group in the fluorocarbonsiloxane of the component (A).

It is preferred that in the fluorocarbon containing ≡SiH groups, one unit of Formula (1) or $R^{10}$ in Formula (1) is a dialkylhydrogensiloxane, the terminal group is a ≡SiH group such as dialkylhydrogensiloxane or silyl, and it can be represented by the following formula (3).

Formula (2)

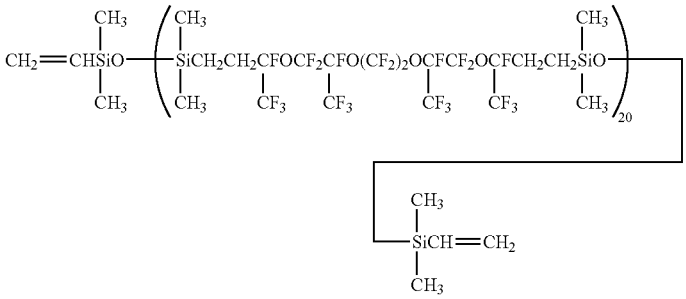

Formula (3)

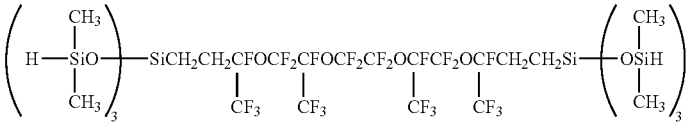

The above filler which is Component (C) may be various fillers used in ordinary silicone rubber compositions. Examples are the above fillers such as for example mist silica, precipitated silica, carbon powder, titanium dioxide, aluminum oxide, quartz powder, talc, sericite and bentonite, or fiber fillers such as asbestos, glass fiber and organic fibers or the like.

Examples of the above catalyst which is Component (D) are chloroplatinic acid which is known in the art as an addition reaction catalyst, alcohol-modified chloroplatinic acid, complexes of chloroplatinic acid and olefins, platinum black or palladium supported on a carrier such as alumina, silica or carbon, and Group VIII elements of the Periodic Table or their compounds such as complexes of rhodium and olefins, chlorotris(triphenylphosphine) rhodium (Wilkinson catalyst) and rhodium (III) acetyl acetonate, and it is preferred to dissolve these complexes in an alcohol, ether or a hydrocarbon solvent.

The fluorocarbonsiloxane rubber composition may further comprise various additives which may be appropriately selected according to an intended purpose. For example, dispersing agents such as diphenylsilane diol, low polymer chain end hydroxyl group-blocked dimethylpolysiloxane and hexamethyl disilazane, heat resistance improvers such as ferrous oxide, ferric oxide, cerium oxide and octyl acid iron, and colorants such as pigments or the like, may be added as necessary.

The above belt member is obtained by covering the surface of a heat resistant resin or metal belt with the above fluorocarbon siloxane rubber composition, and heat curing it, but the composition may be diluted to form a coating solution with a solvent such as m-xylene hexafluoride or benzotrifluoride which is then applied by an ordinary coating method such as spin coating, dip coating or knife coating. The heat curing temperature and time can be conveniently selected, but the selection is generally made, according to the belt type and manufacturing method, within the ranges of from 100° C. to 500° C. and 5 seconds to 5 hours.

The thickness of the fluorocarbonsiloxane rubber layer on the surface of the belt member is not specifically limited, can be appropriately selected according to an intended purpose and is preferably from 20 μm to 500 μm, and more preferably from 40 μm to 200 μm.

The surface roughness of the belt member in terms of arithmetic average roughness Ra is preferably 20 μm or less, more preferably 5 μm or less, and further preferably 1 μm or less, for efficient production of a powder-coated support having excellent surface smoothness and good glossiness. The arithmetic average roughness can be determined according to JIS B 0601, JIS B 0651, and JIS B 0652.

The belt member is not specifically limited, can be appropriately selected according to an intended purpose and is preferably a belt for use in a powder coating machine of cooling-removing type. To produce a powder-coated support continuously and efficiently, the belt member is preferably an endless belt.

Figure 2:
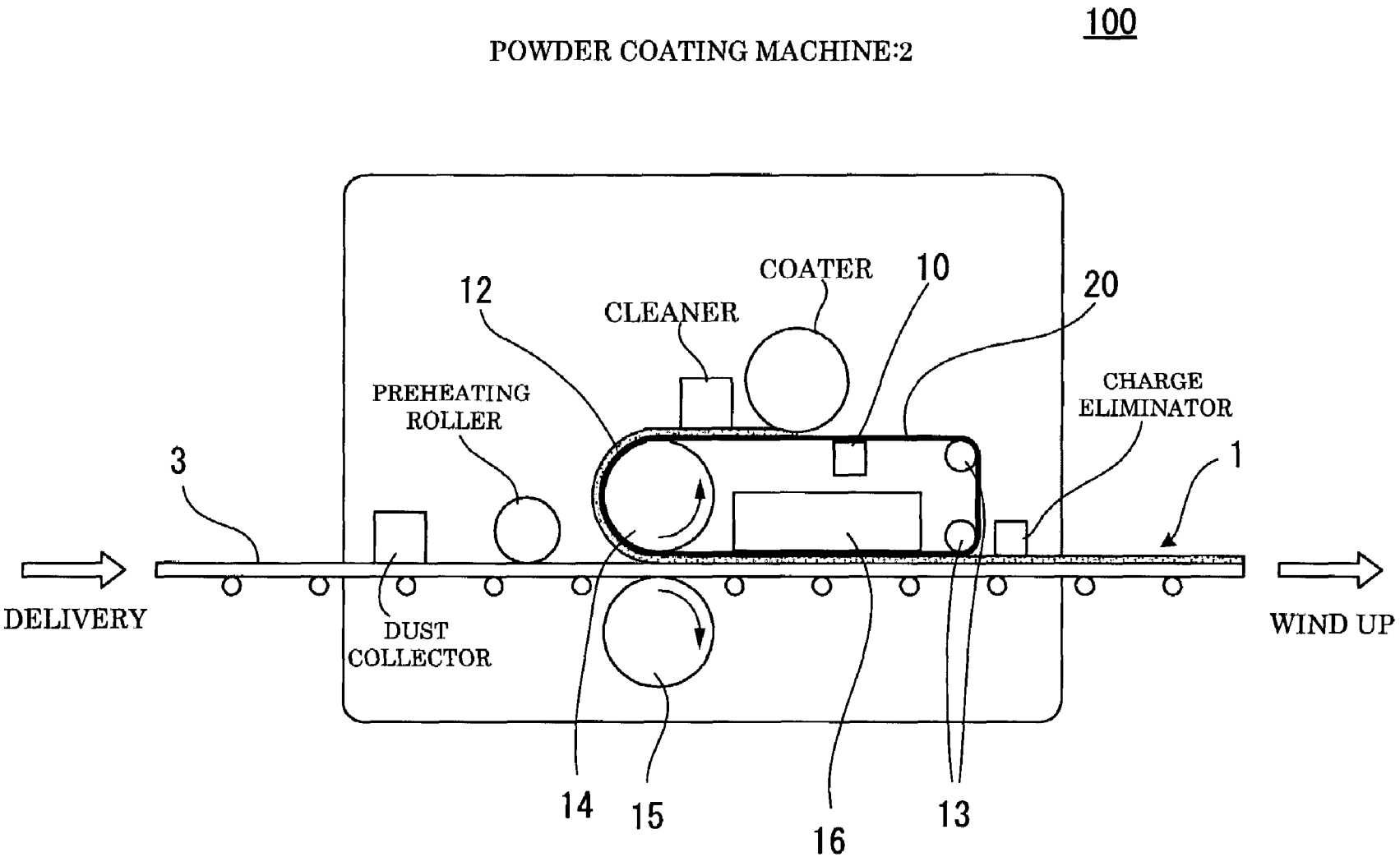
FIG. 2 is a schematic view of another example of a powder coating machine of cooling-removing system for use in the present invention.
Figure 3:
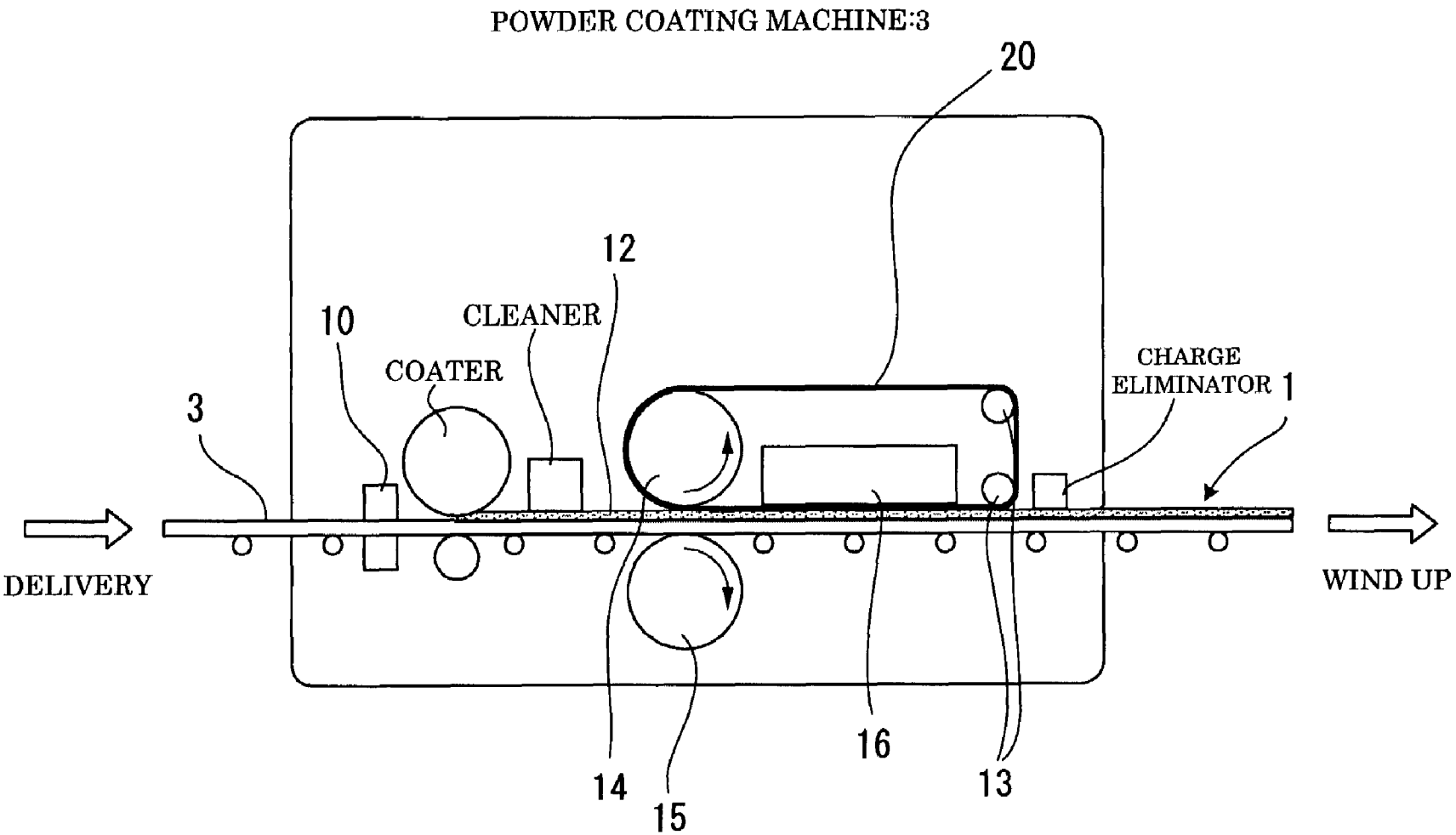
FIG. 3 is a schematic view of still another example of a powder coating machine of cooling-removing system for use in the present invention.

The coating machine that can cool and thereby remove an article is not specifically limited, can be appropriately selected according to an intended purpose and is, for example, one shown in FIG. 1, 2 or 3.

FIG. 1 illustrates an example of a powder coating machine prepared by modifying an electrophotographic copying machine. The powder coating machine 100 comprises a belt 20, a heating roller 14, a pressure roller 15, tension rollers 13, a development unit 5, a light-exposing unit 7, a photoconductor 9, an electrostatic charger 10, and a cooling unit 16.

The development unit 5 contains a powdery resin composition 12 and allows the powdery resin composition 12 to attach to the photoconductor 9. The light-exposing unit 7 applies light to the entire surface of the photoconductor 9 to thereby apply the powdery resin composition to the entire surface thereof. The amount of the applied powdery resin composition can be controlled by changing the intensity of light exposure.

By electrifying the belt 20 using a transfer corotron 11, and-allowing the powdery resin composition 12 is electrostatically attached to the belt 20. The amount of the applied powdery resin composition can be controlled by the degree of electrification. An excess of the applied powdery resin composition may be removed with a cleaner. The excess powdery resin composition can be removed by using a blade, blowing off by air, or aspirating.

Inside the belt 20 are arranged the heating roller 14 and a pair of the tension rollers 13 and 13. The belt 20 is rotatably spanned by action of the heating roller 14 and the pair of the tension rollers 13 and 13 arranged distant from the heating roller 14.

The pressure roller 15 is arranged so as to come in contact with the belt 20 and to face the heating roller 14. A section between the pressure roller 15 and the belt 20 is pressurized by the pressure roller 15 and the heating roller 14 and constitutes a nip.

The cooling unit 16 is arranged inside the belt 20 between the heating roller 14 and one of the tension rollers 13. The heating roller 14 is disposed upstream in a rotating direction of the belt 20, and the tension roller 13 is disposed downstream thereof.

The heating roller 14, the pressure roller 15, and the tension rollers 13 rotate synchronously to thereby allow the belt 20 to rotate.

The belt 20 bearing the electrostatically attached powdery resin composition 12 passes through between the heating roller 14 and the pressure roller 15, is in contact with the base paper 3, and is heated and pressurized to a temperature and pressure at which the powdery resin composition sufficiently fuses (a melt-starting temperature or higher), thereby the fused powdery resin composition 12 is attached to the base paper 3.

The term "melt-starting temperature" as used herein means a temperature at the surface of the powdery resin composition as determined at the heating roller 14, the pressure roller 15, and the nip. The melt-starting temperature is preferably from 80° C. to 190° C., and more preferably from 100° C. to 170° C. The term "pressure" just mentioned above means a pressure at the surface of the powdery resin composition as determined at the heating roller 14, the pressure roller 15, and the nip. The pressure is, for example, preferably from 1 kgf/cm$^2$ to 10 kgf/cm$^2$, and more preferably from 2 kgf/cm$^2$ to 7 kgf/cm$^2$.

The base paper 3 bearing the fused powdery resin composition 12 is conveyed on the belt 20 to the cooling unit 16. The fused powdery resin composition is cooled and solidified therein to thereby yield a powder-coated support having a resin layer. The cooling temperature in the cooling unit 16 is preferably 80° C. or lower, more preferably from 20° C. to 80° C., and further preferably room temperature (around 25° C.) for sufficient solidification of the resin layer.

Powder coating machines shown in FIGS. 2 and 3 have the same configuration as the powder coating machine of FIG. 1, except that they each have different means for applying the powdery resin composition to the base paper. The same components among these machines have the same reference numerals and descriptions thereof are omitted. These powder coating machines shown in FIGS. 2 and 3 can perform the hot pressing operation as in the machine of FIG. 1.

The method according to the present invention can efficiently produce a powder-coated support having satisfactory water resistance and surface smoothness and good glossiness.

Powder-Coated Support

The powder-coated support of the present invention is produced by the production method of the present invention and comprises a base paper and a resin layer at least on one side of the base paper. The resin layer is formed by fusing and solidifying the powdery resin composition. Thus, the resulting powder-coated support has satisfactory water resistance and surface smoothness and good glossiness.

The surface smoothness and glossiness of the powder-coated support in terms of a 20-degrees glossiness is preferably 60 or more, and more preferably 75 or more.

The water resistance of the powder-coated support in terms of a Cobb sizing water absorbency (30 seconds) is preferably 10 g/m$^2$ or less, more preferably 5 g/m$^2$ or less, and further preferably 4 g/m$^2$ or less.

The Cobb sizing water absorbency is absorbency as determined according to JIS P 8140, in which pure water is brought into contact with a sample for 30 seconds.

The powder-coated support of the present invention can be applied to any use not specifically limited. Preferred applications thereof are those which require high water resistance, surface smoothness, and glossiness. The powder-coated support is typically preferably used in image forming materials for electrophotography, ink-jet image forming materials, silver halide photographic materials, rewritable display materials (electronic paper), and printing paper.

Electrophotographic Materials (Image-Forming Sheets for Electrophotography)

The electrophotographic material (image-forming sheet for electrophotography) comprises the powder-coated support of the present invention and at least a toner-image-receiving layer on the powder-coated support. It may further comprise other layers according to necessity.

Toner-Image-Receiving Layer

Thermoplastic resins for use in the toner-image-receiving layer are not specifically limited as long as they can deform at an image-fixing temperature and receive a toner. The thermoplastic resins for use in the toner-image-receiving layer are preferably analogues to a resin used as a binder of the toner. Most of such toners comprise polyester resins, styrene acrylic ester copolymers, and/or styrene-methacrylic copolymers. Accordingly, the thermoplastic resins for use in the toner-image-receiving layer are preferably polyester resins, styrene acrylic ester copolymers, and/or styrene-methacrylic copolymers.

Examples of such thermoplastic resins are as follows.

(i) Thermoplastic resins having an ester bond:

Polyester resins obtained by condensation of a dicarboxylic acid component with an alcohol component. Such dicarboxylic acid components include, but are not limited to, terephthalic acid, isophthalic acid, maleic acid, fumaric acid, phthalic acid, adipic acid, sebacic acid, azelaic acid, abietic acid, succinic acid, trimellitic acid, pyromellitic acid, and other dicarboxylic acids. Each of these dicarboxylic acid components may have a sulfonic acid group, a carboxyl group, or another group substituted thereon. The alcohol components include, but are not limited to, ethylene glycol, diethylene glycol, propylene glycol, bisphenol A, diether derivatives of bisphenol A (e.g., an ethylene oxide diadduct of bisphenol A, and a propylene oxide diadduct of bisphenol A), bisphenol S, 2-ethylcyclohexyldimethanol, neopentyl glycol, cyclohexyldimethanol, glycerol, and other alcohols. Each of these alcohol components may have a hydroxyl group or another group substituted thereon. The resins (i) also include poly(methyl methacrylate), poly(butyl methacrylate), poly(methyl acrylate), poly(butyl acrylate), and other polyacryic ester resins and polymethacrylic ester resins, polycarbonate resins, poly(vinyl acetate) resins, styrene-acrylate resins, styrene-methacrylate copolymer resins, and vinyltoluene-acrylate resins.

Typical disclosure of the resins (i) can be found in, for example, JP-A No. 59-101395, JP-A No. 63-7971, JP-A No. 63-7972, JP-A No. 63-7973, and JP-A No. 60-294862.

Such polyester resins are commercially available under the trade names of, for example, Vylon 290, Vylon 200, Vylon 280, Vylon 300, Vylon 103, Vylon GK-140, and Vylon GK-130 from Toyobo Co., Ltd.; Tuftone NE-382, Tuftone U-5, ATR-2009, and ATR-2010 from Kao Corporation; Elitel UE 3500, UE 3210, and XA-8153 from Unitika Ltd.; and Polyestar TP-220, and R-188 from Nippon Synthetic Chemical Industry Co., Ltd.

(ii) Polyethylene resins, polypropylene resins, and other polyolefin resins; copolymer resins comprising an olefin such as ethylene or propylene with another vinyl monomer; and acrylic resins;

(iii) Polyurethane resins.

(iv) Polyamide resins and urea resins.

(v) Polysulfone resins.

(vi) Polyvinyl chloride resin, polyvinylidence chloride resin, vinyl chloride-vinyl acetate-copolymer resin and vinyl chloride-vinyl propionate copolymer resin.

(vii) Polyol resins such as polyvinyl butyral, and cellulose resins such as ethyl cellulose resin and cellulose acetate resin.

(viii) Polycaprolactone resin, styrene-maleic anhydride resin, polyacrylonitrile resin, polyether resins, epoxy resins and phenol resins.

Each of these thermoplastic resins can be used alone or in combination.

The thermoplastic resin preferably has a molecular weight larger than that of a thermoplastic resin used in the toner. However, this relationship on molecular weight between two thermoplastic resins may not be applied to some cases. For example, when the thermoplastic resin used in the toner-image-receiving layer has a softening point higher than that of the thermoplastic resin used in the toner, the former thermoplastic resin may preferably have a molecular weight equivalent to or lower than that of the latter thermoplastic resin.

A mixture of resins having the same composition but different average molecular weights is also preferably used as the thermoplastic resin. The relationship on molecular weight between the thermoplastic resin used in the toner-image-receiving layer and the thermoplastic resin used in the toner is preferably one disclosed in JP-A No. 08-334915.

The thermoplastic resin used in the toner-image-receiving layer preferably has a particle size distribution larger than that of the thermoplastic resin used in the toner.

The thermoplastic resin for use in the toner-image-receiving layer is preferably formed into a coating liquid. The thermoplastic resin can be any of water-soluble thermoplastic resins and water-dispersible thermoplastic resins as long as they can form a coating liquid.

The water-soluble thermoplastic resins are not specifically limited in their compositions, bonding configurations, molecular structures, molecular weights, molecular weight distributions, shapes, and other factors and can be appropriately selected according to an intended purpose, as long as they are water-soluble resins. To make a thermoplastic resin to be soluble in water, for example, the thermoplastic resin should have a group that imparts solubility in water to the resin. Examples of groups that impart solubility in water to resins are hydroxyl groups, carboxyl groups, amino groups, amide groups, and ether groups.

Typical disclosure of the water-soluble thermoplastic resins can be found in, for example, Research Disclosure No. 17,643, pp. 26; Research Disclosure No. 18,716, pp. 651; Research Disclosure No. 307,105, pp. 873-874; and JP-A No. 64-13546, pp. 71-75 (in Japanese). Specifically, examples of such water-soluble thermoplastic resins are vinylpyrrolidone-vinyl acetate copolymers, styrene-vinylpyrrolidone copolymers, styrene-maleic anhydride copolymers, water-soluble polyesters, water-soluble polyurethanes, water-soluble nylons (water-soluble polyamides), and water-soluble epoxy resins.

Examples of the water-dispersible thermoplastic resins are acrylic resin emulsions, poly(vinyl acetate) emulsions, styrene butadiene rubber (SBR) emulsions, polyester resin emulsions, polystyrene resin emulsions, and urethane resin emulsions. Each of these resins can be used alone or in combination. Gelatin can also be used as the water-soluble or water-dispersible thermoplastic resin. Such gelatin can be any of lime-treated gelatin, acid-treated gelatin, and "decalcified gelatin" having reduced contents of calcium and other minerals as selected according to an intended purpose.

When the toner binder is a polyester resin, the resin for use in the toner-image-receiving layer preferably comprises a polyester resin.

Such polyester resins are commercially available under the trade names of, for example, Vylon 290, Vylon 200, Vylon 280, Vylon 300, Vylon 103, Vylon GK-140, and Vylon GK-130 from Toyobo Co., Ltd.; Tuftone NE-382, Tuftone U-5, ATR-2009, and ATR-2010 from Kao Corporation; Elitel UE 3500, UE 3210, XA-8153 and KZA-7049 from Unitika Ltd.; and Polyestar TP-220, and R-188 from Nippon Synthetic Chemical Industry Co., Ltd.

The acrylic resins are commercially available under the trade names of, for example, Dianal SE-5437, SE-5102, SE-5377, SE-5649, SE-5466, SE-5482, HR-169, HR-124, HR-1127, HR-116, HR-113, HR-148, HR-131, HR-470, HR-634, HR-606, HR-607, LR-1065, LR-574, LR-143, LR-396, LR-637, LR-162, LR-469, LR-216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, and BR-117 from Mitsubishi Rayon Co., Ltd.; Eslec P SE-0020, SE-0040, SE-0070, SE-0100, SE-1010, and SE-1035 from Sekisui Chemical Co., Ltd.; Himer ST 95, and ST 120 from Sanyo Chemical Industries, Ltd.; and FM 601 from Mitsui Chemicals, Inc.

Examples of the polyester emulsions are commercially available under the trade names of Vylonal MD-1250 and MD-1930 from Toyobo Co., Ltd., Japan; Pluscoat Z-446, Z-465, and RZ-96 from Goo Chemical Co., Ltd., Japan; and Pesresin A-160P, A-210, A-515GB, and A-620 from Takamatsu Oil & Fat Co., Ltd., Japan.

The film-forming temperature of the thermoplastic resin is preferably room temperature or higher for better storage before printing, and is preferably 100° C. or lower for better fixing of the toner particles.

The thermoplastic resin for use in the toner-image-receiving layer is preferably a self-dispersible polyester resin emulsion satisfying the following conditions (1) to (4). This type of polyester resin emulsion is self-dispersible requiring no surfactant, is low in moisture absorbency even in an atmosphere at high humidity, exhibits less decrease in its softening point due to moisture and can thereby avoid offset in image-fixing and failures due to adhesion between sheets during storage. The emulsion is water-based and is environmentally friendly and excellent in workability. In addition, the polyester resin used herein readily takes a molecular structure with high cohesive energy. Accordingly, the resin has sufficient hardness (rigidity) during its storage but is melted with low elasticity and low viscosity during an image-fixing process for electrophotography, and the toner is sufficiently embedded in the toner-image-receiving layer to thereby form images having sufficiently high quality.

(1) The number-average molecular weight Mn is preferably from 5000 to 10000 and more preferably from 5000 to 7000.

(2) The molecular weight distribution (Mw/Mn) is preferably 4 or less, and more preferably 3 or less, wherein Mw is the weight-average molecular weight.

(3) The glass transition temperature Tg is preferably from 40° C. to 100° C. and more preferably from 50° C. to 80° C.

(4) The volume average particle diameter is preferably from 20 nm to 200 nm and more preferably from 40 nm to 150 nm.

The amount of the thermoplastic resin is generally preferably 20% by mass or more, and more preferably from 30% by mass to 100% by mass of the toner-image-receiving layer.

The toner-image-receiving layer may further comprise other additives for improving its thermodynamic properties. The other additives include, for example, plasticizers, releasing agents, coloring agents, fillers, crosslinking agents, charge control agents, emulsions, and dispersions.

The plasticizers can be any of known plasticizers for resins. The plasticizers serve to control fluidizing or softening of the toner image receiving layer by action of heat and/or pressure when the toner is fixed.

Typical disclosures of the plasticizers can be found in, for example, Kagaku Binran (Chemical Handbook), ed. by The Chemical Society of Japan, Maruzen Co., Ltd. Tokyo; Plasticizer, Theory and Application, edited and written by Koichi Murai and published by Saiwai Shobo; Volumes 1 and 2 of Studies on Plasticizer, edited by Polymer Chemistry Association; and Handbook on Compounding Ingredients for Rubbers and Plastics, edited by Rubber Digest Co.

Examples of the plasticizers include, for example, esters of the following acids; phthalic, phosphoric, fatty acids, abietic, adipic, sebacic, azelaic, benzoic, butyric, epoxidized fatty acids, glycolic, propionic, trimellitic, citric, sulfonic, carboxylic, succinic, maleic, fumaric, and stearic acid; amides including aliphatic amides and sulfonamides, ethers, alcohols, lactones, poly (ethylene oxide) s (refer to JP-A No. 59-83154, No. 59-178451, No. 59-178453, No. 59-178454, No. 59-178455, No. 59-178457, No. 62-174754, No. 62-245253, No. 61-209444, No. 61-200538, No. 62-8145, No. 62-9348, No. 62-30247, No. 62-136646, and No. 2-235694). The plasticizers can be used by mixing with the resins.

Polymer plasticizers having a relatively low molecular weight can also be used herein. The molecular weight of such a plasticizer is preferably lower than that of a resin to be plasticized and is preferably 15000 or less, and more preferably 5000 or less. When these polymer plasticizers are used, those of the same kind with the resin to be plasticized are preferred. For example, low-molecular-weight polyesters are preferably used for plasticizing a polyester resin. In addition, oligomers can be used as the plasticizers. In addition to the aforementioned compounds, the plasticizers are also commercially available under the trade names of, for example, Adekacizer PN-170 and PN-1430 from Asahi Denka Kogyo Co., Ltd.; PARAPLEX G-25, G-30 and G-40 from C. P. Hall Co.; Ester Gum 8L-JA, Ester R-95, Pentalin 4851, FK 115, 4820 and 830, Luisol 28-JA, Picolastic A75, Picotex LC and Crystalex 3085 from Rika Hercules Co.

The plasticizer can be freely used so as to mitigate stress and/or strain when the toner particles are embedded in the toner-image-receiving layer. Such strain includes, for example, physical strain such as elastic force and viscosity, and strain due to material balance in, for example, molecules, principle chains and/or pendant moieties of the binder.

The plasticizer may be finely dispersed, may undergo micro-phase separation into islands-in-sea structure or may be sufficiently dissolved or miscible with other components such as a binder in the layers.

The content of the plasticizer in the toner-image-receiving layer is preferably from 0.001% by mass to 90% by mass, more preferably from 0.1% by mass to 60% by mass, and further preferably from 1% by mass to 40% by mass.

The plasticizers can be used to control the slipping property leading to the improvement in the transport performance due to friction reduction, improve the anti-offset property during fixing (detachment of toner or layers onto the fixing means) or control the curling property and the charging property for a desirable latent toner image formation.

The releasing agent is incorporated into the toner-image-receiving layer so as to prevent offset of the toner-image-receiving layer. Such releasing agents are not specifically limited and can be appropriately selected, as long as they are melted or fused by heating at an image-fixing temperature, are deposited on the surface of the toner-image-receiving layer and form a layer of the releasing agent on the surface by cooling and solidifying.

The releasing agent can be at least one of silicone compounds, fluorine compounds, waxes, and matting agents. Among them, at least one selected from silicone oils, polyethylene waxes, carnauba waxes, silicone particles, and polyethylene wax particles is preferably used.

As the releasing agents, the compounds mentioned for example in "Properties and Applications of Waxes", Revised Edition, published by Saiwai Shobo, or The Silicon Handbook published by THE NIKKAN KOGYO SHIMBUN, may be used. Further, the silicon compounds, fluorine compounds or waxes used for the toners mentioned in JP-B Nos. 59-38581, 04-32380, Japanese Patents Nos. 2838498, 2949558, JP-A Nos. 50-117433, 52-52640, 57-148755, 61-62056, 61-62057, 61-118760, 02-42451, 03-41465, 04-212175, 04-214570, 04-263267, 05-34966, 05-119514, 06-59502, 06-161150, 06-175396, 06-219040, 06-230600, 06-295093, 07-36210, 07-43940, 07-56387, 07-56390, 07-64335, 07-199681, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049 and 11-194542 can also be used. Moreover, two or more sets of these compounds can be used.

Examples of silicone compounds are non-modified silicone oils (specifically, dimethyl siloxane oil, methyl hydrogen silicone oil, phenyl methyl-silicone oil, or products such as KF-96, KF-96L, KF-96H, KF-99, KF-50, KF-54, KF-56, KF-965, KF-968, KF-994, KF-995 and HIVAC F-4, F-5 from Shin-Etsu Chemical Co., Ltd.; SH200, SH203, SH490, SH510, SH550, SH710, SH704, SH705, SH7028A, SH7036, SM7060, SM7001, SM7706, SH7036, SH8710, SH1107 and SH8627 from Dow Corning Toray Silicone Co., Ltd.; and TSF400, TSF401, TSF404, TSF405, TSF431, TSF433, TSF434, TSF437, TSF450 Series, TSF451 series, TSF456, TSF458 Series, TSF483, TSF484, TSF4045, TSF4300, TSF4600, YF33 Series, YF-3057, YF-3800, YF-3802, YF-3804, YF-3807, YF-3897, XF-3905, XS69-A1753, TEX100, TEX101, TEX102, TEX103, TEX104, TSW831, from Toshiba Silicones), amino-modified silicone oils (e.g., KF-857, KF-858, KF-859, KF-861, KF-864 and KF-880 from Shin-Etsu Chemical Co., Ltd., SF8417 and SM8709 from Dow Corning Toray Silicone Co., Ltd., and TSF4700, TSF4701, TSF4702, TSF4703, TSF4704, TSF4705, TSF4706, TEX150, TEX151 and TEX154 from Toshiba Silicones), carboxy-modified silicone oils (e.g., BY16-880 from Dow Corning Toray Silicone Co., Ltd., TSF4770 and XF42-A9248 from Toshiba Silicones), carbinol-modified silicone oils (e.g., XF42-B0970 from Toshiba Silicones), vinyl-modified silicone oils (e.g., XF40-A1987 from Toshiba Silicones), epoxy-modified silicone oils (e.g., SF8411 and SF8413 from Dow Corning Toray Silicone Co., Ltd.; TSF3965, TSF4730, TSF4732, XF42-A4439, XF42-A4438, XF42-A5041, XC96-A4462, XC96-A4463, XC96-A4464 and TEX170 from Toshiba Silicones), polyether-modified silicone oils (e.g., KF-351 (A), KF-352 (A), KF-353 (A), KF-354 (A), KF-355 (A), KF-615 (A), KF-618 and KF-945 (A) from Shin-Etsu Chemical Co., Ltd.; SH3746, SH3771, SF8421, SF8419, SH8400 and SF8410 from Dow Corning Toray Silicone Co., Ltd.; TSF4440, TSF4441, TSF4445, TSF4446, TSF4450, TSF4452, TSF4453 and TSF4460 from Toshiba Silicones), silanol-modified silicone oils, methacryl-modified silicone oils, mercapto-modified silicone oils, alcohol-modified silicone oils (e.g., SF8427 and SF8428 from Dow Corning Toray Silicone Co., Ltd., TSF4750, TSF4751 and XF42-B0970 from Toshiba Silicones), alkyl-modified silicone oils (e.g., SF8416 from Dow Corning Toray Silicone Co., Ltd., TSF410, TSF411, TSF4420, TSF4421, TSF4422, TSF4450, XF42-334, XF42-A3160 and XF42-A3161 from Toshiba Silicones), fluorine-modified silicone oils (e.g., FS1265 from Dow Corning Toray Silicone Co., Ltd., and FQF501 from Toshiba Silicones), silicone rubbers and silicone particulates (e.g., SH851, SH745U, SH55UA, SE4705U, SH502 UA&B, SRX539U, SE6770 U-P, DY 38-038, DY38-

047, Trefil F-201, F-202, F-250, R-900, R-902A, E-500, E-600, E-601, E-506, BY29-119 from Dow Corning Toray Silicone Co., Ltd.; Tospal 105, 120, 130, 145, 240 and 3120 from Toshiba Silicones), silicone-modified resins (specifically, olefin resins or polyester resins, vinyl resins, polyamide resins, cellulosic resins, phenoxy resins, vinyl chloride-vinyl acetate resins, urethane resins, acrylate resins, styrene-acrylate resins and their copolymerization resins modified by silicone, e.g., Diaroma SP203V, SP712, SP2105 and SP3023 from Dainichiseika Color & Chemicals Mfg. Co., Ltd.; Modepa FS700, FS710, FS720, FS730 and FS770 from NOF CORPORATION; Simac US-270, US-350, US-352, US-380, US-413, US450, Reseda GP-705, GS-30, GF-150 and GF-300 from TOAGOSEI CO., LTD.; SH997, SR2114, SH2104, SR2115, SR2202, DCI-2577, SR2317, SE4001U, SRX625B, SRX643, SRX439U, SRX488U, SH804, SH840, SR2107 and SR2115 from Dow Corning Toray Silicone Co., Ltd., YR3370, TSR1122, TSR102, TSR108, TSR116, TSR117, TSR125A, TSR127B, TSR144, TSR180, TSR187, YR47, YR3187, YR3224, YR3232, YR3270, YR3286, YR3340, YR3365, TEX152, TEX153, TEX171 and TEX172 from Toshiba Silicones), and reactive silicone compounds (specifically, addition reaction type, peroxide-curing type and ultraviolet radiation curing type, e.g., TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A2982, XS56-A3075, XS56-A3969, XS56-A5730, XS56-A8012, XS56-B1794, SL6100, SM3000, SM3030, SM3200 and YSR3022 from Toshiba Silicones).

Examples of fluorine compounds are fluorine oils (e.g., Daifluoryl #1, #3, #10, #20, #50, #100, Unidyne TG-440, TG-452, TG-490, TG-560, TG-561, TG-590, TG-652, TG-670U, TG-991, TG-999, TG-3010, TG-3020 and TG-3510 from Daikin Industries, Ltd.; MF-100, MF-110, MF-120, MF-130, MF-160 and MF-160E from Torchem Products; S-111, S-112, S-113, S-121, S-131, S-132, S-141 and S-145 from Asahi Glass Co., Ltd.; and, FC-430 and FC-431 from DU PONT-MITSUI FLUOROCHEMICALS COMPANY, LTD), fluororubbers (e.g., LS63U from Dow Corning Toray Silicone Co., Ltd.), fluorine-modified resins (e.g., Modepa F220, F600, F2020, FF203, FF204 and F3035 from Nippon Oils and Fats; Diaroma FF203 and FF204 from Dai Nichi Pure Chemicals; Saflon S-381, S-383, S-393, SC-101, SC-105, KH-40 and SA-100 from Asahi Glass Co., Ltd.; E-351, EF-352, EF-801, EF-802, EF-601, TFEA, TFEMA and PDFOH from Torchem Products; and THV-200P from Sumitomo 3M), fluorine sulfonic acid compound (e.g., EF-101, EF-102, EF-103, EF-104, EF-105, EF-112, EF-121, EF-122A, EF-122B, EF-122C, EF-123A, EF-123B, EF-125M, EF-132, EF-135M, EF-305, FBSA, KFBS and LFBS from Torchem Products), fluorosulfonic acid, and fluorine acid compounds or salts (specifically, anhydrous fluoric acid, dilute fluoric acid, fluoroboric acid, zinc fluoroborate, nickel fluoroborate, tin fluoroborate, lead fluoroborate, copper fluoroborate, fluorosilicic acid, fluorinated potassium titanate, perfluorocaprylic acid and ammonium perfluorooctanoate), inorganic fluorides (specifically, aluminum fluoride, potassium fluoride, fluorinated potassium zirconate, fluorinated zinc tetrahydrate, calcium fluoride, lithium fluoride, barium fluoride, tin fluoride, potassium fluoride, acid potassium fluoride, magnesium fluoride, fluorinated titanic acid, fluorinated zirconic acid, ammonium hexafluorinated phosphoric acid and potassium hexafluorinated phosphoric acid).

The waxes include, but are not limited to, synthetic hydrocarbons, modified waxes, hydrogenated waxes, and naturally occurring waxes.

Examples of synthetic hydrocarbons are polyethylene waxes (e.g., Polylon A, 393 and H481 from Chukyo Oils and Fats, and Sanwax E-310, E-330, E-250P, LEL-250, LEL-800 and LEL-400P from Sanyo Chemical Industries, Ltd.), polypropylene waxes (e.g., Biscol 330-P, 550-P and 660-P from Sanyo Chemical Industries, Ltd.), Fischertrops wax (e.g., FT100 and FT-0070 from Japan wax), and acid amide compounds or acid imide compounds (specifically, stearic acid amides and anhydrous phthalic imides such as Cellosol 920, B-495, high micron G-270, G-110 and hydrin D-757 from Chukyo Oils and Fats).

Examples of modified waxes are amine-modified polypropylenes (e.g., QN-7700 from Sanyo Chemical Industries, Ltd.), acrylic acid-modified, fluorine-modified or olefin-modified waxes, urethane waxes (e.g., NPS-6010 and HAD-5090 from Japan Wax), and alcohol waxes (e.g., NPS-9210, NPS-9215, OX-1949 and XO-020T from Japan Wax).

Examples of hydrogenated waxes are castor oil (e.g., castor wax from Itoh Oil Chemicals Co., Ltd., castor oil derivatives (e.g., dehydrated castor oil DCO, DCO Z-1, DCO Z-3, castor oil fatty acid CO-FA, ricinoleic acid, dehydrated castor oil fatty acid DCO-FA, dehydrated castor oil fatty acid epoxy ester 4 ester, castor oil urethane acrylate CA-10, CA-20, CA-30, castor oil derivative MINERASOL S-74, S-80, S-203, S-42×, S-321, special castor oil condensation fatty acid MINERASOL RC-2, RC-17, RC-55, RC-335, special castor oil condensation fatty acid ester MINERASOL LB-601, LB-603, LB-604, LB-702, LB-703, #11 and L-164 from Itoh Oil Chemicals Co., Ltd.), stearic acid (e.g., 12-hydroxystearic acid from Itoh Oil Chemicals Co., Ltd.), lauric acid, myristic acid, palmitic acid, behenic acid, sebacic acid (e.g., sebacic acid from Itoh Oil Chemicals Co., Ltd.), undecylenic acid (e.g., undecylenic acid from Itoh Oil Chemicals Co., Ltd.), heptyl acids (heptyl acids from Itoh Oil Chemicals Co., Ltd.), maleic acid, high grade maleic oils (e.g., HIMALEIN DC-15, LN-10, 00-15, DF-20 and SF-20 from Itoh Oil Chemicals Co., Ltd.), blown oils (e.g., selbonol #10, #30, #60, R-40 and S-7 from Itoh Oil Chemicals Co., Ltd.) and synthetic waxes such as cyclopentadieneic oils (CP oil and CP oil-S from Itoh Oil Chemicals Co., Ltd.).

Preferred examples of the naturally occurring waxes are vegetable waxes, animal waxes, mineral waxes, and petroleum waxes, of which vegetable waxes are typically preferred. When an aqueous thermoplastic resin is used as the thermoplastic resin in the toner-image-receiving layer, water-dispersible waxes are specifically preferred for their higher miscibility with the aqueous thermoplastic resin.

Examples of vegetable waxes are carnauba waxes (e.g., EMUSTAR AR-0413 from Japan Wax, and Cellosol 524 from Chukyo Oils and Fats), castor oil (purified castor oil from Itoh Oil Chemicals Co., Ltd.), rape oil, soybean oil, Japan tallow, cotton wax, rice wax, sugarcane wax, candelilla wax, Japan wax and jojoba oil. Among them, carnauba waxes having a melting point of 70° C. to 95° C. are preferred, since the resulting image-receiving sheet has excellent anti-offset properties and adhesion resistance, can pass through a machine smoothly, has good glossiness, invites less cracking and can form high-quality images.

The animal waxes include, but are not limited to, beeswaxes, lanolin, spermaceti waxes, whale oils, and wool waxes.

Examples of mineral waxes are natural waxes such as montan wax, montan ester wax, ozokerite and ceresin, or fatty acid esters (Sansosizer-DOA, AN-800, DINA, DIDA, DOZ, DOS, TOTM, TITM, E-PS, NE-PS, E-PO, E-4030, E-6000, E-2000H, E-9000H, TCP and C-1100, New Japan Chemical Co., Ltd.). Among them, montan waxes having a melting point of 70° C. to 95° C. are preferred, since the resulting image-receiving sheet has excellent anti-offset properties and adhesion resistance, can pass through a machine smoothly, has good glossiness, invites less cracking and can form high-quality images.

Preferred examples of petroleum waxes may for example be a paraffin wax (e.g., Paraffin wax 155, 150, 140, 135, 130, 125, 120, 115, HNP-3, HNP-5, HNP-9, HNP-10, HNP-11, HNP-12, HNP-14G, SP-0160, SP-0145, SP-1040, SP-1035, SP-3040, SP-3035, NPS-8070, NPS-L-70, OX-2151, OX-2251, EMUSTAR-0384 and EMUSTAR-0136 from Japan Wax; Cellosol 686, 428, 651-A, A, H-803, B460, E-172, 866, K-133, hydrin D-337 and E-139 from Chukyo Oils and Fats; 125 paraffin, 125° FD, 130° paraffin, 135° paraffin, 135° H, 140° paraffin, 140° N, 145° paraffin and paraffin wax M from Nisseki Mitsubishi Petroleum), or a microcrystalline wax (e.g., Hi-Mic-2095, Hi-Mic-3090, Hi-Mic-1080, Hi-Mic-1070, Hi-Mic-2065, Hi-Mic-1045, Hi-Mic-2045, EMUSTAR-0001 and EMUSTAR-042X from Japan Wax; Cellosol 967, M, from Chukyo Oils and Fats; 55 Microwax and 180 Microwax from Nisseki Mitsubishi Petroleum), and petrolatum (e.g., OX-1749, OX-0450, OX-0650B, OX-0153, OX-261BN, OX-0851, OX-0550, OX-0750B, JP-1500, JP-056R and JP-011P from Japan Wax).

The content of the naturally occurring wax in the toner-image-receiving layer (surface layer) is preferably from 0.1 $g/m^2$ to 4 $g/m^2$, and more preferably from 0.2 $g/m^2$ to 2 $g/m^2$.

If the content is less than 0.1 $g/m^2$, sufficient anti-offset properties and adhesion resistance may not be obtained. If it exceeds 4 $g/m^2$, the resulting images may decreased quality due to excessive wax.

To obtain satisfactory anti-offset properties and to allow the sheet to pass through a machine smoothly, the melting point of the naturally occurring wax is preferably from 70° C. to 95° C., and more preferably from 75° C. to 90° C.

The matting agents include various conventional matting agents. Solid particles for use in the matting agents can be classified as inorganic particles (inorganic matting agents) and organic particles (organic matting agents).

Specifically, inorganic matting agents may be oxides (for example, silicon dioxide, titanium oxide, magnesium oxide, aluminum oxide), alkaline earth metal salts (for example, barium sulfate, calcium carbonate, magnesium sulfate), silver halides (for example, silver chloride or silver bromide), and glass.

Examples of inorganic matting agents are given for example in West German Patent No. 2529321, UK Patents Nos. 760775, 1260772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

The above organic matting agent contains starch, cellulose ester (for example, cellulose-acetate propionate), cellulose ether (for example, ethyl cellulose) and a synthetic resin. It is preferred that the synthetic resin is insoluble or difficultly soluble. Examples of insoluble or difficultly soluble synthetic resins include poly(meth)acrylic esters, e.g., polyalkyl(meth)acrylate and polyalkoxyalkyl(meth) acrylate, polyglycidyl(meth)acrylate), poly(meth) acrylamide, polyvinyl esters (e.g., polyvinyl acetate), polyacrylonitrile, polyolefins (e.g., polyethylene), polystyrene, benzoguanamine resin, formaldehyde condensation polymer, epoxy resins, polyamides, polycarbonates, phenolic resins, polyvinyl carbazole and polyvinylidene chloride. Copolymers which combine the monomers used in the above polymers, may also be used.

In the case of the above copolymers, a small amount of hydrophilic repeating units may be included. Examples of monomers which form a hydrophilic repeating unit are acrylic acid, methacrylic acid, α,β-unsaturated dicarboxylic acid, hydroxyalkyl(meth)acrylate, sulfoalkyl (meth)acrylate and styrene sulfonic acid.

Examples of organic matting agents are for example given in UK Patent No. 1055713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, 57-14835.

Also, two or more types of solid particles may be used in conjunction as matting agents. The average particle size of the solid particles may conveniently be, for example, 1 μm to 100 μm, but is preferably 4 μm to 30 μm. The usage amount of the solid particles may conveniently be 0.01 $g/m^2$ to 0.5 $g/m^2$, but is preferably 0.02 $g/m^2$ to 0.3 $g/m^2$.

The releasing agents for use in the toner-image-receiving layer can also be derivatives, oxides, purified products, and mixtures of the aforementioned substances. These releasing agents may each have a reactive substituent.

To obtain satisfactory anti-offset properties and to allow the sheet to pass through a machine smoothly, the melting point of the releasing agent is preferably from 70° C. to 95° C., and more preferably from 75° C. to 90° C.

When an aqueous thermoplastic resin is used as the thermoplastic resin in the toner-image-receiving layer, water-dispersible releasing agents are specifically preferred for higher miscibility with the aqueous thermoplastic resin.

The content of the releasing agent in the toner-image-receiving layer is preferably from 0.1% by mass to 10% by mass, more preferably from 0.3% by mass to 8.0% by mass, and further preferably from 0.5% by mass to 5.0% by mass.

Examples of colorants are optical whitening agents, white pigments, colored pigments and dyes.

The above optical whitening agent has absorption in the near-ultraviolet region, and is a compound which emits fluorescence at 400 nm to 500 nm. The various optical whitening agents known in the art may be used without any particular limitation. As this optical whitening agent, the compounds described in "The Chemistry of Synthetic Dyes" Volume V, Chapter 8 edited by K. Venkataraman can conveniently be mentioned. Specific examples are stilbene compounds, coumarin compounds, biphenyl compounds, benzo-oxazoline compounds, naphthalimide compounds, pyrazoline compounds and carbostyryl compounds. Examples of these are white furfar-PSN, PHR, HCS, PCS, B from Sumitomo Chemicals, and UVITEX-OB from Ciba-Geigy.

Examples of white pigments are the inorganic pigments (e.g., titanium oxide, calcium carbonate, etc.).

Examples of organic pigments are various pigments and azo pigments described in JP-A No. 6344653, (e.g., azo lakes such as carmine 6B and red 2B, insoluble azo compounds such as mono-azo yellow, pyrazolo orange and Balkan orange, and condensed azo compounds such as chromophthal yellow and chromophthal red), polycyclic pigments (e.g., phthalocyanines such as copper phthalocyanine blue and copper phthalocyanine green), thioxadines such as thioxadine violet, isoindolinones such as isoindolinone yellow, surenes such as perylene, perinon, hulavanthoron and thioindigo, lake pigments (e.g., Malachite Green, Rhodamine B, Rhodamine G and Victoria Blue B), and inorganic pigments (e.g., oxides, titanium dioxide and red ocher, sulfates such as precipitated barium sulfate, carbonates such as precipitated calcium carbonates, silicates such as water-containing silicates and anhydrous silicates, metal powders such as aluminum powder, bronze powder and zinc dust, carbon black, chrome yellow and Berlin blue).

One of these may be used alone, or two or more may be used in conjunction. Of these, titanium oxide is particularly preferred as the pigment.

There is no particular limitation on the form of the pigment, but hollow particles are preferred from the viewpoint that they have excellent heat conduction properties (low heat conduction properties) during image fixing.

The various dyes known in the art may be used as the above dye.

Examples of oil-soluble dyes are anthraquinone compounds and azo compounds.

Examples of water-insoluble dyes are vat dyes such as C.I. Vat violet 1, C.I. Vat violet 2, C.I. Vat violet 9, C.I. Vat violet 13, C.I. Vat violet 21, C.I. Vat blue 1, C.I. Vat blue 3, C.I. Vat blue 4, C.I. Vat blue 6, C.I. Vat blue 14, C.I. Vat blue 20 and C.I. Vat blue 35, disperse dyes such as C.I. disperse violet 1, C.I. disperse violet 4, C.I. disperse violet 10, C.I. disperse blue 3, C.I. disperse blue 7 and C.I. disperse blue 58, and oil-soluble dyes such as C. I. solvent violet 13, C.I. solvent violet 14, C.I. solvent violet 21, C.I. solvent violet 27, C.I. solvent blue 11, C.I. solvent blue 12, C.I. solvent blue 25 and C.I. solvent blue 55.

Colored couplers used in silver halide photography may also be used to advantage.

The amount ($g/m^2$) of colorant in the above toner-image-receiving layer (surface) is preferably 0.1 $g/m^2$ to 8 $g/m^2$, but more preferably 0.5 $g/m^2$ to 5 $g/m^2$.

If the amount of colorant is less than 0.1 $g/m^2$, the light transmittance in the toner-image-receiving layer is high, and if the amount of the above colorant exceeds 8 $g/m^2$, handling becomes more difficult due to cracks, and adhesion resistance.

Among these coloring agents, the amount of the pigment is preferably less than 40% by mass, more preferably less than 30% by mass, and further preferably less than 20% by mass based on the mass of the thermoplastic resin constituting the toner-image-receiving layer.

The filler may be an organic or inorganic filler, and reinforcers for binder resins, bulking agents and reinforcements known in the art may be used.

This filler may be selected by referring to "Handbook of Rubber and Plastics Additives" (ed. Rubber Digest Co.), "Plastics Blending Agents—Basics and Applications" (New Edition) (Taisei Co.) and "The Filler Handbook" (Taisei Co.).

As the filler, various inorganic fillers (or pigments) can be used. Examples of inorganic pigments are silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate and mullite. Silica and alumina are particularly preferred. One of these fillers may be used alone, or two or more may be used in conjunction. It is preferred that the filler has a small particle diameter. If the particle diameter is large, the surface of the toner-image-receiving layer tends to become rough.

Silica includes spherical silica and amorphous silica. The silica may be synthesized by the dry method, wet method or aerogel method. The surface of the hydrophobic silica particles may also be treated by trimethylsilyl groups or silicone. Colloidal silica is preferred. The average mean particle diameter of the silica is preferably 4 nm to 120 nm, but more preferably 4 nm to 90 nm.

The silica is preferably porous. The average pore size of porous silica is preferably 50 nm to 500 nm. Also, the average pore volume per mass of porous silica is preferably 0.5 ml/g to 3 ml/g, for example.

Alumina includes anhydrous alumina and hydrated alumina. Examples of crystallized anhydrous aluminas which may be used are $\alpha$, $\beta$, $\gamma$, $\delta$, $\xi$, $\eta$, $\theta$, $\kappa$, $\rho$ or $\chi$. Hydrated alumina is preferred to anhydrous alumina. The hydrated alumina may be a monohydrate or trihydrate. Monohydrates include pseudo-boehmite, boehmite and diaspore. Trihydrates include gypsite and bayerite. The average particle diameter of alumina is preferably 4 nm to 300 nm, but more preferably 4 nm to 200 nm. Porous alumina is preferred. The average pore size of porous alumina is preferably 50 nm to 500 nm. The average pore volume per mass of porous alumina is of the order of 0.3 ml/g to 3 ml/g.

The alumina hydrate can be synthesized by the sol-gel method wherein ammonia is added to an aluminum salt solution to precipitate alumina, or by hydrolysis of an alkali aluminate. Anhydrous alumina can be obtained by dehydrating alumina hydrate by the action of heat.

It is preferred that the filler is 5 parts by mass to 2000 parts by mass, relative to the dry mass of the binder in the toner image-receiving layer where the filler is to be added.

A crosslinking agent can be added in order to adjust the storage stability or thermoplastic properties of the toner-image-receiving layer. Examples of this crosslinking agent are compounds containing two or more reactive groups in the molecule such as epoxy, isocyanate, aldehyde, active halogen, active methylene, acetylene and other reactive groups known in the art.

The crosslinking agent may also be a compound having two or more groups able to form bonds such as hydrogen bonds, ionic bonds or coordination bonds.

The crosslinking agent may be a compound known in the art such as a resin coupling agent, curing agent, polymerizing agent, polymerization promoter, coagulant, film-forming agent or film-forming assistant. Examples of coupling agents are chlorosilanes, vinylsilanes, epoxisilanes, aminosilanes, alkoxyaluminum chelates, titanate coupling agents or other agents known in the art such as those mentioned in "Handbook of Rubber and Plastics Additives" (ed. Rubber Digest Co.).

The charge control agents can be used for controlling transfer and attachment of the toner, and for preventing adhesion of the image-receiving sheet due to charging.

The charge control agent may be any charge control agent known in the art, i.e., surfactants such as cationic surfactants, anionic surfactants, amphoteric surfactants, non-ionic surfactants, and polymer electrolytes or electroconducting metal oxides.

Examples of the surfactants are cationic charge inhibitors such as quarternary ammonium salts, polyamine derivatives, cation-modified polymethylmethacrylate, cation-modified polystyrene, anionic charge inhibitors such as alkyl phosphates and anionic polymers, or non-ionic charge inhibitors such as polyethylene oxide. When the toner has a negative charge, cationic charge inhibitors and non-ionic charge inhibitors are preferred.

Examples of electroconducting metal oxides are ZnO, $TiO_2$, $SnO_2$, Al2$O_3$, In2$O_3$, $SiO_2$, MgO, BaO and $MoO_3$. These electroconducting metal oxides may be used alone, or they may be used in the form of a complex oxide.

Also, the electroconducting metal oxides may contain other elements, for example ZnO may contain Al or In, $TiO_2$ may contain Nb or Ta, and $SnO_2$ may contain Sb, Nb or halogen elements (doping).

The materials used to obtain the toner-image-receiving layer of the present invention may also contain various additives to improve stability of the output image or improve stability of the toner-image-receiving layer itself. Examples of additives are antioxidants, age resistors, degradation inhibitors, anti-ozone degradation inhibitors, ultraviolet light absorbers, metal complexes, light stabilizers or preservatives.

Examples of antioxidants are chroman compounds, coumarane compounds, phenol compounds (e.g., hindered phenols), hydroquinone derivatives, hindered amine derivatives and spiroindan compounds. Antioxidants are given for example in JP-A No. 61-159644.

Examples of age resistors are given in "Handbook of Rubber and Plastics Additives", Second Edition (1993, Rubber Digest Co.), pp76-121.

Examples of ultraviolet light absorbers are benzotriazo compounds (U.S. Pat. No. 3,533,794), 4-thiazolidone compounds (U.S. Pat. No. 3,352,681), benzophenone compounds (JP-A No. 46-2784) and ultraviolet light absorbing polymers (JP-A No. 62-260152).

Examples of metal complexes are given in U.S. Pat. Nos. 4,241,155, 4,245,018, 4254195, and JP-A Nos. 61-88256, 62-174741, 63-199248, 01-75568, 01-74272.

Photographic additives known in the art may also be added to the material used to obtain the toner-image-receiving layer as described above. Examples of photographic additives are given in the Journal of Research Disclosure (hereafter referred to as RD) No. 17643 (December 1978), No. 18716 (November 1979) and No. 307105 (November 1989), the relevant sections being summarised below.

| Type of additive | RD17643 | RD18716 | RD307105 |
|---|---|---|---|
| 1. Whitener | p24 | p648, right-hand column | p868 |
| 2. Stabilizer | pp. 24-25 | p649, right-hand column | pp. 868-870 |
| 3. Light absorbers (ultraviolet ray absorbers) | pp. 25-26 | p649, right-hand column | p873 |
| 4. Pigment image stabilizers | p25 | p650, right-hand column | p872 |
| 5. Film-hardening agents | p26 | p651, left-hand column | pp. 874-875 |
| 6. Binders | p26 | p651, left-hand column | pp. 873-874 |
| 7. Plasticizers, lubricants | p27 | p650, right-hand column | p876 |
| 8. Coating assistants (surfactants) | pp. 26-27 | p650, right-hand column | pp. 875-876 |
| 9. Antistatic agents | p27 | p650, right-hand column | pp. 867-877 |
| 10. Matting agents | | | pp. 878-879 |

The toner-image-receiving layer is prepared by applying a coating composition containing a polymer for use in the toner-image-receiving layer using, for example, a wire coater, and drying the coated layer onto the above powder-coated support. The coating composition is prepared, for example, by dissolving or homogeneously dispersing a thermoplastic resin, and additives such as a plasticizer in an organic solvent such as alcohols and ketones. Organic solvents for use herein include, but are not limited to, methanol, isopropyl alcohol, and methyl ethyl ketone. If the polymer for use in the toner-image-receiving layer is soluble in water, the toner-image-receiving layer can be prepared by applying an aqueous solution of the polymer onto the above powder-coated support. If not, the toner-image-receiving layer can be prepared by applying an aqueous dispersion of the polymer onto the above powder-coated support.

The film-forming temperature of the polymer for use in the present invention is preferably room temperature or higher for better storage before printing, and is preferably 100° C. or lower for better image-fixing of the toner particles.

The toner-image-receiving layer is coated so that the coating mass after drying is for example 1 g/$m^2$ to 20 g/$m^2$, but preferably 4 g/$m^2$ to 15 g/$m^2$. There is no particular limitation on the thickness of the toner-image-receiving layer, but it is preferably 1 μm to 30 μm and more preferably 2 μm to 20 μm.

Physical Properties of Toner-Image-Receiving Layer

It is preferred that the toner-image-receiving layer has a high degree of whiteness. This whiteness is measured by the method specified in JIS P 8123, and is preferably 85% or more. It is preferred that the spectral reflectance is 85% or more in the wavelength region of 440 nm to 640 nm, and that the difference between the maximum spectral reflectance and minimum spectral reflectance in this wavelength range is within 5%. Further, it is preferred that the spectral reflectance is 85% or more in the wavelength region of 400 nm to 700 nm, and that the difference between the maximum spectral reflectance and minimum spectral reflectance in this wavelength range is within 5%.

Specifically, regarding the whiteness, the L* value is preferably 80 or higher, preferably 85 or higher and still more preferably 90 or higher in a CIE 1976 (L*a*b*) color space. The tone of the white color should preferably be as neutral as possible. Regarding the whiteness tone, the value of $(a^*)^2+(b^*)^2$ is preferably 50 or less, more preferably 18 or less and still more preferably 5 or less in a (L*a*b*) space.

It is preferred that the toner-image-receiving layer has high gloss. The gloss is 45, preferably 60 or higher, more preferably 75 or higher and still more preferably 90 or higher over the whole range from white where there is no toner, to black where there is maximum density.

However, the gloss is preferably less than 110. If it exceeds 110, the image has a metallic appearance which is undesirable.

Gloss may be measured based on JIS Z 8741.

It is preferred that the toner-image-receiving layer has a high smoothness. The arithmetic mean roughness (Ra) is preferably 3 μm or less, more preferably 1 μm or less and still more preferably 0.5 μm or less over the whole range from white where there is no toner, to black where there is maximum density.

Arithmetic mean roughness may be measured based on JIS B 0601, JIS B 0651 and JIS B 0652.

It is preferred that the toner-image-receiving layer has one of the following physical properties, more preferred that it has several of the following physical properties, and most preferred that it has all of the following physical properties.

(1) The glass transition point Tg of the toner-image-receiving layer is preferably 30° C. or higher and is equal to or lower than a temperature 20° C. higher than Tg of the toner.

(2) The softening point $T_{1/2}$ of the toner-image-receiving layer as determined by a one-half method is preferably from 60° C. to 200° C., and more preferably from 80° C. to 170° C. The softening point as determined by the one-half method is measured in the following manner. A sample is preheated at an initial set temperature (e.g., 50° C.) for a predetermined time (e.g., 300 seconds) and is then heated at a set constant heating rate using a specific apparatus under specific conditions at a set extrusion load. The softening point $T_{1/2}$ is defined as a temperature such that the difference of piston stroke between the starting and completion of flowing becomes one half.

(3) The flow starting point (flow beginning temperature) Tfb of the toner-image-receiving layer is preferably from 40° C. to 200° C. and is preferably equal to or lower than a temperature 50° C. higher than Tfb of the toner.

(4) A temperature at which the viscosity of the toner-image-receiving layer becomes $1\times10^5$ cP is preferably 40° C. or higher and the viscosity of the toner-image-receiving layer is preferably lower than that of the toner.

(5) The storage modulus (G') of the toner-image-receiving layer is preferably from $1\times10^2$ Pa to $1\times10^5$ Pa and the loss modulus (G") thereof is preferably from $1\times10^2$ Pa to $1\times10^5$ Pa at an image-fixing temperature.

(6) The loss tangent (G"/G') as the ratio of the loss modulus (G") to the storage modulus (G') of the toner-image-receiving layer at an image-fixing temperature is preferably from 0.01 to 10.

(7) The storage modulus (G') of the toner-image-receiving layer at an image-fixing temperature preferably falls in a range of −50 to +2500 of the storage modulus (G") of the toner at an image-fixing temperature.

(8) A fused toner forms an inclination with the toner-image-receiving layer of preferably 50 degrees or less and more preferably 40 degrees or less.

The toner-image-receiving layer preferably also satisfies the physical properties given in Japanese Patent No. 2788358, and JP-A Nos. 07-248637,08-305067 and 10-239889.

The physical property (1), Tg, can be determined using a differential scanning calorimeter (DSC). The physical properties (2) and (3), $T_{1/2}$ and Tfb, can be determined by using, for example, a Flow Tester CFT-500 (trade name, available from Shimadzu Corporation). The physical properties (5), (6) and (7), storage modulus (G'), loss modulus (G") and loss tangent (G"/G'), can be determined by using, for example, a rotary rheometer such as Dynamic Analyzer RAD II (trade name, available from Rheometrics Inc.). The physical property (8), angle of inclination, can be determined using a contact angle meter available from Kyowa Kaimen Kagaku Co., Ltd., Japan according to a process disclosed in JP-A No. 08-334916.

It is preferred that the surface electrical resistance of the toner-image-receiving layer is within the range of $1\times10^6$ Ω/cm$^2$ to $1\times10^{15}$ Ω/cm$^2$ (under conditions of 25° C., 65% RH)

If the surface electrical resistance is less than $1\times10^6$ Ω/cm$^2$, the toner amount transferred to the toner-image-receiving layer is insufficient, and the density of the toner image obtained may be too low. On the other hand, if the surface electrical resistance exceeds $1\times10^{15}$ Ω/cm$^2$, more charge than necessary is produced during transfer, toner is transferred insufficiently, image density is low and static electricity develops causing dust to adhere during handling of the image-receiving sheet for electrophotography, or misfeed, overfeed, discharge marks or toner transfer dropout may occur.

Also, the surface electrical resistance of the surface on the opposite side of the carrier to the toner-image-receiving layer is preferably $5\times10^8$ Ω/cm$^2$ to $3.2\times10^{10}$ Ω/cm$^2$, and more preferably $1\times10^9$ Ω/cm$^2$ to $1\times10^{10}$ Ω/cm$^2$.

The above surface electrical resistances were measured based on JIS K 6911. The sample was left with air-conditioning for 8 hours or more at a temperature of 20° C. and humidity 65%. Measurements were made using an Advantest Ltd. R8340 under the same environmental conditions after passing a current for 1 minute at an applied voltage of 100V.

In the image-receiving sheet for electrophotography, other layers other than the toner-image-receiving layer may for example include a surface protection layer, back layer, contact improving layer, intermediate layer, underlayer, cushion layer, charge regulating (inhibiting) layer, reflecting layer, color toner adjusting layer, storage improving layer, anti-sticking layer, anti-curl layer and smoothing layer. These layers may be used alone, or two or more may be used in combination.

There is no particular limitation on the thickness of the electrostatic image-receiving sheet of the present invention, which may be suitably selected according to the purpose, but it is for example preferably 50 μm to 350 μm, and more preferably 100 μm to 280 μm.

Image Formation

The image-receiving sheet for electrophotography can be used in electrophotographic image formation using a toner for electrophotography and can be advantageously used for color image formation using color toners for electrophotography.

The toner for electrophotography is not specifically limited, can be appropriately selected according to an intended purpose and can be prepared by any process such as pulverization or suspension-granulation.

The toner for electrophotography obtained by pulverization is prepared by kneading, pulverization and classification. Binder resins for use in the production of the color toners for electrophotography by pulverization include, for example, resins obtained by polymerization of a monomer such as acrylic acid, methacrylic acid, maleic acid, other acids, and esters thereof; as well as esters; sulfonates; ethers; urethanes; and resins obtained by copolymerization of two or more of these monomers. The color toner can be prepared by, for example, sufficiently kneading the binder resin, a wax component, and other toner materials in a heat kneader such as a heat roll, a kneader or an extruder, and mechanically pulverizing and classifying the kneaded product.

The content of the wax component, for example, in the color toner for electrophotography obtained by pulverization is preferably from 0.1% by mass to 10% by mass, and more preferably from 0.5% by mass to 7% by mass, based on the total mass of the toner.

The color toner for electrophotography obtained by suspension-granulation can be prepared in the following manner. Initially, a binder resin, a coloring agent, a mold releasing agent, as well as a magnetic material, a charge control agent, and other additives according to necessity are mixed in a solvent immiscible with water, the resulting composition is covered with a polymer having carboxyl groups, is dispersed in an aqueous medium in the presence of a hydrophilic inorganic dispersing agent with a BET specific surface area of 10 m$^2$/g to 50 m$^2$/g and/or a viscosity modifier, where necessary the resulting suspension is diluted with an aqueous medium, the solvent in the resulting suspension is then removed by heating and/or reducing pressure and thereby yields the color toner. The color toners for electrophotography obtained by suspension-granulation are more preferably in the present invention than those obtained by pulverization.

The binder resin for use in the color toners for electrophotography obtained by suspension-granulation can be any of known binder resins selected according to an intended purpose. Examples of such binder resins are homopolymers and copolymers of monomers such as styrene, chlorostyrene, and other styrenes; ethylene, propylene, butylene, isoprene, and other monoolefins; vinyl acetate, vinyl propionate, vinyl benzoate, vinyl butyrate, and other vinyl esters; methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, and other α-methylene aliphatic monocarboxylic esters; vinyl methyl ether, vinyl ethyl ether, vinyl butyl ether, and other vinyl ethers; and vinyl methyl ketone, vinyl hexyl ketone, vinyl isopropenyl ketone, and other vinyl ketones.

Typical examples of the binder resins are polystyrene resins, polyester resins, styrene-alkyl acrylate copolymers, styrene-alkyl methacrylate copolymers, styrene-acrylonitrile copolymers, styrene-butadiene copolymers, styrene-maleic anhydride copolymers, polyethylene resins, and polypropylene resins. Preferred examples of the binder resins are polyurethane resins, epoxy resins, silicone resins, polyamide resins, modified rosins, paraffins, and waxes. Among them, styrene-acrylic resins are especially preferred.

Coloring agents for use in the color toner can be any of conventional or known coloring agents. Such coloring agents include, for example, carbon black, Aniline Blue, Chalcoyl Blue, Chrome Yellow, Ultramarine Blue, Du Pont Oil Red, Quinoline Yellow, Methylene Blue chloride, Phthalocyanine Blue, Malachite Green oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1, and C.I. Pigment Blue 15:3.

The content of the coloring agent is preferably from 2% by mass to 8% by mass of the toner. If the content of the coloring agent is less than 2% by mass, the color toner for electrophotography may not have satisfactory color. If it exceeds 8% by mass, the toner may have deteriorated transparency.

The mold releasing agent includes, but is not limited to, polyethylenes, polypropylenes, polybutenes, and other low-molecular-weight polyolefins; silicone resins; oleamide, erucamide, ricinoleamide, stearamide, and other aliphatic amides; carnauba wax, rice bran wax, candelilla wax, Japan wax, jojoba oil, and other vegetable-origin waxes; beeswax, and other animal-origin waxes; montan wax, ozokerite, ceresin, paraffin waxes, microcrystalline waxes, Fischer-Tropsch waxes, and other mineral/petroleum-origin waxes; and modified products of these substances. Among them, waxes having high polarity, such as carnauba wax and candelilla wax, are apt to be exposed from the toner particle surface. In contrast, those having low polarity, such as polyethylene wax and paraffin wax, are apt to be less exposed from the toner particle surface. The wax has a melting point of preferably from 30° C. to 150° C., and more preferably from 40° C. to 140° C.

The toner for electrophotography mainly comprises the coloring agent and the binder resin. The average particle diameter of the toner is preferably from about 3 μm to about 15 μm, and more preferably from about 4 μm to about 8 μm. The storage modulus G' of the toner for electrophotography itself is preferably from 10 Pa to 200 Pa as determined at 150° C. at an angular frequency of 10 rad/sec.

The toner for electrophotography may further comprise at least one external additive. Such external additives include fine particles of inorganic compounds, and fine particles of organic compounds.

Such fine particles of inorganic compounds are made from, for example, $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, CaO—$SiO_2$, $K_2O$—$(TiO_2)_n$, $Al_2O_3$-$2SiO_2$, $CaCO_3$, $MgCO_3$, $BaSO_4$, and $MgSO_4$.

The fine particles of organic compounds include, for example, fine particles of aliphatic acids, derivatives thereof, and metal salts thereof, and fine particles of resins such as fluorine-containing resins, polyethylene resins, and acrylic resins.

An image can be formed on the image-receiving sheet for electrophotography using the toner or color toner for electrophotography by any process that can be appropriately selected according to an intended purpose, using a known electrophotographic image forming apparatus.

The image forming apparatus comprises a transport section for the image-receiving sheet, a latent electrostatic image forming section, a development section arranged in the vicinity of the latent electrostatic image forming section, and an image-fixing section. Some of these apparatus may have an intermediate transfer section at a center part thereof in the vicinity of the latent electrostatic image forming section and the transport section.

The intermediate transfer section is incorporated into an image forming apparatus of intermediate belt transfer system in which a toner image is primarily transferred to the intermediate transfer belt and is then secondarily transferred to an image-receiving sheet for electrophotography. This system is different from a direct transfer system in which a toner image formed on a development roller is directly transferred to an image-receiving sheet for electrophotography.

The image formation of intermediate belt transfer system can form high-quality images more easily than image formation according to regular electrophotographic system.

To further improve image quality, an adhesive transfer system or a heat-aided transfer system instead of, or in combination with, electrostatic transfer or bias roller transfer has been known. Specific configurations of these systems can be found in, for example, JP-A No. 63-113576 and JP-A No. 05-341666. A method using an intermediate image transfer belt according to the heat-aided transfer system is preferred when a color toner for electrophotography having a small average particle diameter is used. The intermediate image transfer belt can be, for example, an endless belt made of an electrocast nickel having a silicone or fluorine-containing thin film on its surface and thereby having releasing capability.

The apparatus preferably has a cooling unit in the image fixing belt after transfer of the toner to the image-receiving sheet. In other words, the apparatus preferably has a cooling unit in the image transfer belt after thermally fixing the toner to the surface of the toner-image-receiving layer with the interposition of the image fixing belt and before the surface of the toner-image-receiving layer cooled and solidified while being attached to the image fixing belt. By action of the cooling unit, the toner for electrophotography can be cooled to a temperature equal to or lower than the softening point or glass transition point of the binder used therein and can reproduce the shape of the surface of the image fixing belt on the surface of the image-receiving sheet to thereby yield a uniform image.

The image-fixing process is an important process that control glossiness and smoothness of the resulting images. The image-fixing process includes, for example, an image-fixing process using a hot pressing roller, and a belt image-fixing process using a belt. For better image quality such as the glossiness and smoothness, the belt image-fixing process is preferred.

Thus, an image using the toner for electrophotography or a color image using the color toner for electrophotography is formed on the image-receiving sheet.

The powder-coated support of the present invention can be used in any of image forming materials and image fixing materials such as the aforementioned electrophotographic materials, as well as thermosensitive materials, sublimation transfer materials, silver halide photographic materials, ink-jet recording materials, and thermal transfer materials.

Thermosensitive Materials

An example of the thermosensitive materials is a thermosensitive coloring material comprising the powder-coated support and at least a heat coloring (heat developing) layer on the support and is used in a thermo-autochrome process (TA process). In the TA process, an image is formed by heating with a thermosensitive head, image-fixing by application of ultraviolet rays, and repeating these procedures.

Sublimation Transfer Materials

An example of the sublimation transfer materials is one which comprises the powder-coated support and at least an ink layer containing a thermally diffusible dye (sublimation dye) arranged on the support and is used in a sublimation transfer process in which the thermally diffusible dye is transferred from the ink layer to a image receiving sheet for thermosensitive transfer recording by heating with a thermal head.

Thermal Transfer Materials

An example of the thermal transfer materials is one which comprises the powder-coated support and at least a hot-melt ink layer as an image forming layer arranged on the support and is used in a fusion transfer process in which an ink is transferred from the hot-melt ink layer to an image-receiving sheet for thermal transfer recording by heating with a thermal head.

Silver Halide Photographic Materials

An example of the silver halide photographic materials is one which comprises the powder-coated support and at least an image forming layer arranged on the support and is used in a silver halide photographic process in which an printed and light-exposed sheet for silver halide photo is immersed in and transported through plural treatment tanks to thereby subjecting the sheet color development, bleaching and image-fixing, and washing with water and is then dried.

Ink-Jet Recording Materials

An example of the ink-jet recording materials is one which comprises the powder-coated support and a coloring material receiving layer arranged on the support. The coloring material receiving layer can receive a liquid ink such as a water-based ink using a dye or pigment as a coloring material and an oily ink or a solid ink that is solid at ordinary temperature and is fused and liquefied before image formation.

The powder-coated support of the present invention can also be used in printing paper, electronic paper, and other applications.

Printing Paper

The powder-coated support of the present invention is also preferably used as printing paper. In this case, the support preferably has high mechanical strength, since an ink or another coloring material is applied using a printing machine.

When a base paper is used as the base paper, the base paper preferably comprises a filler, a softening agent, an internal additive for paper making, and other additives according to necessity. Such fillers can be those generally used and include, but are not limited to, clay, calcined clay, diatomaceous earth, talc, kaolin, calcined kaolin, delaminated kaolin, calcium carbonate heavy, calcium carbonate light, magnesium carbonate, barium carbonate, titanium dioxide, zinc oxide, silicon oxide, amorphous silica, aluminum hydroxide, calcium hydroxide, magnesium hydroxide, zinc hydroxide, and other inorganic fillers; and urea-formaldehyde resins, polystyrene resins, phenolic resins, fine hollow particles, and other organic fillers. Each of these fillers can be used alone or in combination.

The internal additive for paper making includes, but is not limited to, conventional nonionic, cationic, or anionic yield improvers, freeness improvers, paper strengthening agents, and internal sizing agents. More specifically, such internal additives include aluminum sulfate, aluminum chloride, sodium aluminate, basic aluminum chloride, basic poly (aluminum hydroxide)s, and other basic aluminum compounds; ferrous sulfate, ferric sulfate, and other polyvalent metallic compounds, starch, modified starch, polyacrylamides, urea resins, melamine resins, epoxy resins, polyamide resins, polyamine resins, polyethyleneimines, vegetable gums, poly(vinyl alcohol)s, latices, poly(ethylene oxide)s, and other water-soluble polymers, hydrophilic crosslinked polymer particle dispersions, and derivatives and modified products thereof. These substances may have plural functions as the internal additive for paper making concurrently.

Substances that significantly play a role as an internal sizing agent include, for example, alkylketene dimer compounds, alkenyl succinic anhydride compounds, styrene-acrylic compounds, higher fatty acid compounds, petroleum resin sizing agents, and rosin sizing agents.

The base paper may further comprise other internal additives such as dyes, fluorescent brightening agents, pH adjusters, antifoaming agents, pitch control agents, slime control agents according to the use.

The printing paper is typically useful as an offset printing paper and can also be used as letterpress printing paper, gravure printing paper, and paper for electrophotography.

Rewritable Display Materials (Electronic Paper)

As the rewritable display materials, an electronic paper is typically preferred. The electronic paper includes, for example, EC element electronic paper using an EC element, electrophoretic electronic paper utilizing electrophoresis, and twist-ball electronic paper, each of which uses the powder-coated support of the present invention as a support. Among them, EC element electronic paper is preferred, since it has a wide angle of visibility, has a simple structure, can be upsized easily, and can yield various color tone by selecting its materials. In addition, its display can remain at rest only by blocking motion of electrons and maintaining redox conditions, and the EC element electronic paper can satisfactorily store information in memory, consumes low power and can maintain its display without power consumption.

Electrochromic (EC) Element Electronic Paper

The EC element electronic paper preferably comprises the powder-coated support of the present invention and at least an EC element arranged on the support, which EC element comprises an electrochromic coloring layer and a pair of electrodes sandwiching the electrochromic coloring layer.

The electrochromic coloring layer is not specifically limited and may comprise, for example, a conventionally known electrochromic coloring matter, and an electrolyte.

The electrochromic coloring matter is not specifically limited and can be appropriately selected, as long as it can develop or quench a color by at least one of electrochemical oxidizing reaction or reducing reaction. Preferred examples thereof are organic compounds and metal complexes. Each of these substances can be used alone or in combination.

The metal complexes include, for example, Prussian blue, metal-bipyridyl complexes, metal-phenanthroline complexes, metal-phthalocyanine complexes, metal ferricyanides, and derivatives thereof.

The organic compounds include, but are not limited to, (1) pyridine compounds, (2) conductive polymers, (3) styryl compounds, (4) donor-acceptor type compounds, and (5) other organic coloring matters.

Examples of the pyridine compounds (1) are viologens; heptyl viologens such as diheptylviologen dibromide; methylene bispyridinium; phenanthroline; azobipyridinium; 2,2-bipyridinium complexes; and quinoline-isoquinoline.

Examples of the conductive polymers (2) are polypyrroles, polythiophenes, polyanilines, polyphenylenediamines, polyaminophenols, polyvinylcarbazoles, polymeric viologen polyion complexes, tetrathiafulvalene (TTF), and derivatives of these substances.

Examples of the styryl compounds (3) are

2-[2-[4-(dimethylamino)phenyl]ethenyl]-3,3-dimethylindolino[2,1-b]oxazolidine,

2-[4-[4-(dimethylamino)phenyl]-1,3-butadienyl]-3,3-dimethylindolino[2,1-b]oxazolidine, 2-[2-[4-(dimethylamino)phenyl]ethenyl]-3,3-dimethyl-5-methylsulfonylindolino[2,1-b]oxazolidine, 2-[4-[4-(dimethylamino)phenyl]-1,3-butadienyl]-3,3-dimethyl-5-sulfonylindolino[2,1-b]oxazolidine, 3,3-dimethyl-2-[2-(9-ethyl-3-carbazolyl)ethenyl]indolino[2,1-b]oxazolidine, and 2-[2-[4-(acetylamino)phenyl]ethenyl]-3,3-dimethylindolino[2,1-b]oxazolidine.

Examples of the donor-acceptor compounds (4) are tetracyanoquinodimethane, and tetrathiafulvalene.

Examples of the other organic coloring matters (5) are carbazole, methoxybiphenyl, anthraquinone, quinone, diphenylamine, aminophenol, Tris-aminophenylamine, phenylacetylene, cyclopentyl compounds, benzodithiolium compounds, squarylium salts, cyanine, rare earth phthalocyanine complexes, ruthenium diphthalocyanine, merocyanine, phenanthroline complexes, pyrazoline, oxidation-reduction indicators, pH indicators, and derivatives of these substances.

Among them, viologens, heptyl viologens such as diheptyl viologen dibromide, and other viologen dyes are preferred.

Two or more of the electrochromic coloring matters can be used in any combination selected according to an intended purpose. Such combinations include, for example, a combination of viologen and polyaniline, a combination of polypyrrole and polymethylthiophene, and a combination of polyaniline and Prussian blue.

The electrolyte includes, but is not limited to, iodine, bromine, LiI, NaI, KI, CsI, $CaI_2$, LiBr, NaBr, KBr, CsBr, $CaBr_2$, and other metal halides; tetramethylammonium iodide, tetrapropylammonium iodide, tetrabutylammonium iodide, tetramethylammonium bromide, tetraethylammonium bromide, tetrabutylammonium bromide, and other halides of ammonium compounds; methylviologen chloride, hexylviologen bromide, and other alkylviologens; hydroquinone, naphthohydroquinone, and other polyhydroxybenzenes; ferrocene, ferrocyanic salts, and other iron complexes. Each of these electrolytes can be used alone or in combination.

The method of the present invention can efficiently produce the powder-coated support of the present invention having excellent water resistance and surface smoothness and good glossiness. The powder-coated support of the present invention can be advantageously used as sheet materials, supports, and other materials in various applications.

The present invention will now be described in further detail with reference to specific examples and comparative examples, but the present invention is not limited thereto.

EXAMPLE 1

Manufacture of Support

A broadleaf kraft pulp (LBKP) was beated to 300 ml (Canadian Standard Freeness, C.S.F.) by a disk refiner, and adjusted to 0.58 mm of fiber length. Additives were added in the following proportions to this pulp, based on the mass of pulp.

| Type of additive | Amount (%) |
|---|---|
| Cationic starch | 1.2 |
| Alkyl ketene dimer (AKD) | 0.5 |
| Anionic polyacrylamide | 0.3 |
| Epoxy fatty acid amide (EFA) | 0.2 |
| Polyamide polyamine epichlorohydrine | 0.3 |

Notes

AKD is an alkyl ketene dimer (the alkyl part derives from a fatty acid based on behenic acid), and EFA is an epoxy fatty acid amide (the fatty acid part derives from a fatty acid based on behenic acid).

A raw paper of weighting 150 g/m$^2$ was produced from the obtained pulp by a fortlinear paper machine. 1.0 g/m$^2$ PVA and 0.8 g/m$^2$ $CaCl_2$were made to adhere thereto by a size press device in the middle of the drying zone of the fortlinear paper machine.

In the last step of the paper-making process, the density was adjusted to 1.01 g/cm$^3$ using a soft calender. The paper was passed through so that the side (surface) of the raw paper whereon the toner-image-receiving layer is provided, came into contact with the metal roller. The surface temperature of the metal roller was 140° C. The Wang Research smoothness of the obtained base paper was 265 seconds, and the Stokigt sizing degree was 127 seconds.

Preparation of Powdery Resin Composition A linear polyester resin was synthetically prepared from terephthalic acid, bisphenol A ethylene oxide adduct, and cyclohexanedimethanol (molar ratio: 5:4:1). The linear polyester resin had a glass transition point Tg of 62° C., a number-average molecular weight Mn of 4500, and a weight-average molecular weight Mw of 10000.

The linear polyester resin was pulverized in a jet mill, was classified with an air classifier and thereby yielded transparent fine particles having an average particle diameter ($d_{50}$) of 7 μm. To 100 parts by mass of the transparent fine particles were added 1.1 parts by mass of $SiO_2$ and 1.4 parts by weight of $TiO_2$, the mixture was blended in a high-speed mixer to apply $SiO_2$ and $TiO_2$ to the transparent fine particles and thereby yielded a powdery resin composition. The $SiO_2$ had been treated with a silane coupling agent to allow its surface to be hydrophobic and had an average particle diameter of 0.05 μm. The $TiO_2$ had been treated with a silane coupling agent to allow its surface to be hydrophobic and had an average particle diameter of 0.02 μm and a refractive index of 2.5.

The above-prepared powdery resin composition had a density of 1.1 g/cm$^3$. The molecular weight of the polyester resin was determined using gel permeation chromatography with tetrahydrofuran as an eluent. The average particle diameter of the powdery resin composition was determined using a Coulter Counter (available from Beckman Coulter Inc.) and was expressed as a mass-average particle diameter $d_{50}$.

A total of 8 parts by weight of the powdery resin composition was added to 100 parts by weight of a carrier, spherical ferrite particles, having an average particle diameter of about 50 μm, which surface had been coated with a styrene-methyl methacrylate copolymer. The mixture was mixed in a TURBULA shaker-mixer (available from Shinmaru Enterprises Corporation, Japan) and thereby yielded a two-component powdery resin composition supported on the carrier.

Hot Pressing

The two-component powdery resin composition was subjected to hot pressing in the powder coating machine 1 shown in FIG. 1 which had been modified from an electrophotographic copying machine.

Specifically, the two-component powdery resin composition was placed in the development unit 5, was attached to the photoconductor 9, was irradiated with light using the light-exposing unit 7 to thereby coat the entire surface of the photoconductor 9 with the powdery resin composition. The amount of the powdery resin composition can be controlled by changing the intensity of light-exposure.

By electrifying the belt 20 with the transfer corotron 11, powdery resin composition is electrostatically attached to the belt 20. An excess of the attached powdery resin composition was removed with a cleaner by using a blade, blowing off by air, or aspirating.

The belt 20 bearing the electrostatically attached powdery resin composition 12 passed through between the heating roller 14 and the pressure roller 15, was in contact with the base paper 3, and was heated and pressurized to a temperature and pressure at which the powdery resin composition sufficiently fuses (melt-starting temperature or higher), thereby the fused powder resin composition 12 was attached to the base paper 3. In this procedure, the heating temperature was 145° C. and the pressure between the rollers (nip pressure) was 7.5 kgf/cm$^2$.

The belt had, on its surface, a thin film made from at least one selected from silicone rubbers, fluorine rubbers, silicone resins, and fluorocarbon resins.

EXAMPLE 2

A powder-coated support was prepared by the procedure of Example 1, except that an acrylic resin was used as the thermoplastic resin in the powdery resin composition.

EXAMPLE 3

A powder-coated support was prepared by the procedure of Example 2, except that rutile-type titanium dioxide as a white pigment was further kneaded into the powdery resin composition in an amount of 10% by mass based on the thermoplastic resin.

COMPARATIVE EXAMPLE 1

The base paper used in Example 1 was used as a support without powder coating.

COMPARATIVE EXAMPLE 2

Latex-coated support A thermoplastic resin latex-containing coating liquid having the following composition and having a minimum film-forming temperature (MFT) of 35° C. was applied to a backside of a raw paper used in Example 1 to an amount of 64 g/m$^2$ using a bar coater, and the resulting coated film was air-dried at 50° C. Another portion of the thermoplastic resin latex-containing coating liquid was then further applied to the front side of the raw paper to an amount of 64 g/m$^2$ using a bar coater, and the resulting coated film was air-dried at 50° C. The support was then subjected to aftertreatment in an aftertreatment machine of cooling-eliminating system (endlesspress) with its front side facing a belt.

Preparation of Thermoplastic Resin Latex-Containing Coating Liquid

The thermoplastic resin latex-containing coating liquid was prepared by mixing 100 g of a thermoplastic resin latex, 0.25 g of an anionic surfactant AOT (AEROSOL-OT, trade name, available from Cytec Industries Ltd., NJ), 3 g of a thickening agent, 10 g of a white pigment dispersion, and 1 g of a fluorescent brightening agent dispersion. The thermoplastic resin latex was a soap-free acrylic resin latex Aquabrid 4635 (available from Daicel Chemical Industries, Ltd., Japan) having a solid content of 35% by mass, a glass transition point Tg of 60° C., and a minimum film-forming temperature (MFT) of 30° C. The thickening agent was a polyethylene oxide having a molecular weight of 100000. The white pigment dispersion contained 40% by mass of a titanium dioxide, 5% by mass of PVA-205 (available from Kuraray Co., Ltd., Japan), and a small amount of an anionic surfactant. The fluorescent brightening agent dispersion contained 46% by mass of UVITEX-OB (available from Ciba Specialty Chemicals, Switzerland), and small amounts of nonionic and anionic surfactants.

The glossiness, water resistance and waviness of the supports according to Examples 1 to 3 and Comparative Examples 1 and 2 were determined by the following methods. The results are shown in Table 1.

Glossiness

The 20-degrees glossiness of a sample support was determined according to JIS Z 8741.

Water Resistance

The Cobb sizing water absorbency (30 seconds) of a sample support was determined according to a method as specified in JIS P 8140. The Cobb sizing water absorbency is an absorbency as determined after the sample support is brought into contact with pure water for 30 seconds.

Waviness

The waviness of a sample support was determined by measuring roughness of the sample using a three-dimensional roughness meter NANOMETRO 110F (trade name, available from Kuroda Precision Industries Ltd., Japan) at a measurement area of 30 mm times 50 mm, a measurement speed of 30 mm/sec and a pitch of 0.1 mm with a cutoff of 7 mm or more and 8 mm or less.

TABLE 1

| | Resin | Color | Glossiness | Cobb sizing water absorbency ($g/m^2$) | Waviness |
|---|---|---|---|---|---|
| Ex. 1 | polyester | transparent | 86 | 1.2 | 0.30 |
| Ex. 2 | acrylic resin | transparent | 74 | 0.7 | 0.31 |
| Ex. 3 | acrylic resin | white | 76 | 0.9 | 0.31 |
| Com. Ex. 1 | (raw paper) | – | 0 | 33.8 | 0.33 |
| Com. Ex. 2 | latex | white | 35 | 6.5 | 0.37 |

According to the method of the present invention, a powdery resin composition at least comprising a thermoplastic resin is applied to at least on one side of a base paper and is subjected to hot pressing. Thus, a powder-coated support having excellent smoothness and glossiness can be efficiently produced by a simple procedure without requiring a drying process. In this method, resins that are hardly formed into latices or aqueous solutions can be used without limitation.

What is claimed is:

1. A method for producing a powder-coated support, comprising the steps of:

applying a powdery resin composition to at least one side of a base paper, the powdery resin composition containing at least a thermoplastic resin; and hot-pressing the powdery resin composition on the base paper, wherein the step of hot-pressing comprises subjecting the coated layer of the powdery resin composition on the base paper to hot-pressing and then cooling with a belt member and a roller of a powder coating machine that can cool and thereby remove an article; and removing the coated layer on the base paper from the belt member.

2. A method for producing a powder-coated support according to claim 1, further comprising electrostatically applying the powdery resin composition to the at least one side of the base paper.

3. A method for producing a powder-coated support according to claim 1, further comprising:

hot-pressing the coated layer to a melt-starting temperature of the thermoplastic resin in the powdery resin composition or higher; and cooling the heated and pressurized coated layer to a temperature of 80° C. or lower.

4. A method for producing a powder-coated support according to claim 1, wherein the thermoplastic resin in the powdery resin composition is at least one selected from polyester resins, acrylic resins, styrene-acrylic resins, polyethylene resins, ionomer resins, and polyurethane resins.

5. A method for producing a powder-coated support according to claim 1, wherein the powdery resin composition further contains a white pigment.

6. A method for producing a powder-coated support according to claim 1, wherein the powdery resin composition further contains at least one of fine inorganic particles and fine organic particles.

7. A method for producing a powder-coated support according to claim 1, wherein the powdery resin composition is one of a transparent powdery resin composition and a white powdery resin composition.

8. A method for producing a powder-coated support according to claim 1, wherein the belt member has a surface roughness in terms of an arithmetic average roughness Ra of 20 μm or less.

9. A method for producing a powder-coated support according to claim 1, wherein the belt member is an endless belt.

10. A method for producing a powder-coated support according to claim 1, wherein the belt member has a layer on its surface, the layer containing at least one selected from silicone rubbers, fluorocarbon rubbers, silicone resins, fluorocarbon resins, and mixtures thereof.

11. A powder-coated support comprising:

a base paper; and a resin layer disposed on at least one side of the base, wherein the powder-coated support is produced by:

applying the powdery resin composition to at least one side of the base paper, the powdery resin composition containing at least a thermoplastic resin; and hot-pressing the powdery resin composition on the base paper to thereby fuse and solidify the powdery resin composition to form the resin layers, wherein the step of hot-pressing comprises subjecting the coated layer of the powdery resin composition on the base paper to hot-pressing and then cooling with a belt member and a roller of a powder coating machine that can cool and thereby remove an article; and removing the coated layer on the base paper from the belt member.

12. A powder-coated support according to claim 11, wherein the powdery resin composition is electrostatically applied to the at least one side of the base paper.

13. A powder-coated support according to claim 11, wherein the powder-coated support has a Cobb sizing water absorbency of 10 $g/m^2$ or less.

14. A powder-coated support according to claim 11, wherein the powder-coated support has a surface glossiness in terms of 20-degrees glossiness of 45 or more.

15. An electrophotographic material comprising:

a powder-coated support; and a toner-image-receiving layer on the powder-coated support, wherein the powder-coated support comprises:

a base paper; and a resin layer disposed on at least one side of the base, and wherein the powder-coated support is produced by:

applying the powdery resin composition to at least one side of the base paper, the powdery resin composition containing at least a thermoplastic resin; and hot-pressing the powdery resin composition on the base paper to thereby fuse and solidify the powdery resin composition to form the resin layer.

* * * * *